US011261578B2

(12) United States Patent
Ishida et al.

(10) Patent No.: US 11,261,578 B2
(45) Date of Patent: Mar. 1, 2022

(54) WORK MACHINE

(71) Applicant: HITACHI CONSTRUCTION MACHINERY CO., LTD., Tokyo (JP)

(72) Inventors: Toshihiko Ishida, Hitachi (JP); Manabu Edamura, Kasumigaura (JP); Hidekazu Moriki, Mito (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 254 days.

(21) Appl. No.: 16/330,410

(22) PCT Filed: Nov. 15, 2017

(86) PCT No.: PCT/JP2017/041134
§ 371 (c)(1),
(2) Date: Mar. 5, 2019

(87) PCT Pub. No.: WO2018/173361
PCT Pub. Date: Sep. 27, 2018

(65) Prior Publication Data

US 2020/0224383 A1 Jul. 16, 2020

(30) Foreign Application Priority Data

Mar. 21, 2017 (JP) ..... JP2017-055060

(51) Int. Cl.
*E02F 3/43* (2006.01)
*E02F 9/20* (2006.01)
(Continued)

(52) U.S. Cl.
CPC ..... *E02F 3/435* (2013.01); *E02F 9/2004* (2013.01); *E02F 9/2271* (2013.01); *E02F 9/265* (2013.01)

(58) Field of Classification Search
CPC ..... E02F 3/435; E02F 9/2004; E02F 9/2271; E02F 9/265
See application file for complete search history.

(56) References Cited

U.S. PATENT DOCUMENTS 5,835,874 A 11/1998 Hirata et al.
2012/0263566 A1 10/2012 Taylor et al.
2017/0268198 A1* 9/2017 Shimano ..... E02F 9/2033

FOREIGN PATENT DOCUMENTS

JP 07-290545 A 11/1995
JP 10-8492 A 1/1998
(Continued)

OTHER PUBLICATIONS

International Search Report of PCT/JP2017/041134 dated Jan. 30, 2018.
(Continued)

*Primary Examiner* — Thomas G Black
*Assistant Examiner* — Tarek Elarabi
(74) *Attorney, Agent, or Firm* — Mattingly & Malur, PC.

(57) ABSTRACT

A hydraulic excavator (1) provided with a controller (40) having a machine control section (43) that executes machine control for moving a work implement (1A) following a predetermined condition at the time of operation of operation devices (45*a*, 45*b*, and 46*c*) includes a level-of-intervention input device (96) that is operated by an operator. The controller includes a correction amount calculating section (43*m*) that calculates a correction amount of a level of intervention indicating a degree of intervention by the machine control in an operation of the work implement instructed through operation of the operation devices, based on an operation amount of the level-of-intervention input device. The machine control section executes the machine control to intervene in the operation of the work implement instructed through the operation of the operation devices at
(Continued)

a level of intervention corrected based on the correction amount calculated at the correction amount calculating section.

6 Claims, 16 Drawing Sheets

(51) Int. Cl.
*E02F 9/22* (2006.01)
*E02F 9/26* (2006.01)

(56) References Cited

FOREIGN PATENT DOCUMENTS

| | | | |
|---|---|---|---|
| JP | 3056254 | B2 | 6/2000 |
| JP | 2011-157789 | A | 8/2011 |
| JP | 2017-053160 | A | 3/2017 |
| WO | 2017/043112 | A1 | 3/2017 |

OTHER PUBLICATIONS

International Preliminary Report on Patentability received in corresponding International Application No. PCT/JP2017/041134 dated Oct. 3, 2019.
Extended European Search Report received in corresponding European Application No. 17901977.3 dated Jan. 15, 2021.

* cited by examiner

WORK MACHINE

TECHNICAL FIELD

The present invention relates to a work machine on which machine control is executable.

BACKGROUND ART

Some hydraulic excavators are provided with control systems to assist excavating operation of operators. Specifically, if excavating operation (for example, an arm crowding instruction) is input via an operation device, a control system executes control to forcibly move at least a boom cylinder among the boom cylinder, an arm cylinder, and a bucket cylinder to drive a work implement (also called a front work implement) (for example, to forcibly perform a boom raising operation by extending the boom cylinder) such that the position of the tip (for example, a toe of a bucket) of the work implement is kept in an area on and above a target surface, based on the positional relationship between the target surface and the tip of the work implement. By utilizing such a control system that limits an area in which the tip of the work implement can move makes it easy to perform excavated surface finishing works or face-of-slope shaping works. Hereinbelow, this type of control is called "area limiting control," "intervention control (on operator operation)," or "machine control (MC)" in some cases.

In relation to this type of technique, Patent Document 1 points out that the speed of excavation in a direction along a target surface (an area beyond which entrance is not allowed) lowers, and the efficiency lowers if, when the bucket toe approaches the target surface, the speed of the bucket toe is lowered irrespective of the direction of movement of the bucket toe. Then, as a solution to this, Patent Document 1 describes a method of control in which, among components of the movement speed of the bucket toe, only a component vertical to the target surface is limited by intervention control, and a speed component parallel to the target surface is given, as is, a signal of operation by an operator as a front operation command, but is not subjected to intervention control.

PRIOR ART DOCUMENT

Patent Document

Patent Document 1: JP-3056254

SUMMARY OF THE INVENTION

Problem to be Solved by the Invention

An excavator with a machine control function like the one in the above-mentioned prior art document (hereinafter, referred to as an "MC machine" in some cases) can be applied to a situation of so-called information-oriented construction to perform excavation/shape formation of a design surface by controlling the machine body such that the bucket toe position moves along a design surface (target surface) given as electronic information. In this case, the bucket toe position in a coordinate system set to the machine (excavator coordinate system) is calculated from a sensing value of a posture sensor of the work implement, the position and orientation of the machine in the coordinate system set to the earth (world coordinate system) are calculated utilizing the global navigation satellite system (GNSS) or the like, and both (the toe position in the excavator coordinate system, and the position and orientation of the vehicle in the world coordinate system) are combined; thereby, the toe position in the world coordinate system can be calculated. Then, if the machine body is controlled such that the toe position in the world coordinate system moves along the target surface, excavation/shape formation of the target surface (design surface) becomes possible.

In works to excavate/form shapes of the target surface in this manner, in order to level the excavated surface along the target surface, compaction works called slope-tamping is performed, in which a boom lowering operation is performed, and the excavated surface is pressed substantially vertically with a bucket rear surface. Slope-tamping works require repeated slope-tamping at substantially constant pressing force suited to the nature of soil, and the operation requires skills. In view of this, work machines that can adjust and maintain the pressing force for slope-tamping are required irrespective of the skills of operators. In addition, since, during execution of MC, the operation of the front work implement beyond the target surface is suppressed even if boom lowering operation is performed for the purpose of slope-tamping, pressure cannot be applied to the excavated surface with the bucket rear surface. That is, since slope-tamping cannot be performed during execution of MC, if an excavator according to the prior art document is used, MC needs to be turned off every time slope-tamping is to be performed. Furthermore, since normally, after completion of the slope-tamping works, finishing works to move the bucket toe along the target surface is performed under MC, the MC function that is once turned off before the slope-tamping works should be turned on, and this series of switching operation places a burden on operators.

The present invention has been invented in view of the above-mentioned circumstances, and an object thereof is to provide a work machine having a machine control function and capable of adjusting and maintaining the pressing force at the time of slope-tamping.

Means for Solving the Problem

Among a plurality of means that are included in the present application and are for solving the above-mentioned problems, one example thereof provides a work machine provided with: a work implement driven by a plurality of hydraulic actuators; an operation device that instructs the work implement on an operation according to operation by an operator; and a controller having a machine control section that executes machine control for moving the work implement following a predetermined condition at time of operation of the operation device, the work machine including: a level-of-intervention input device that is operated by the operator, in which the controller further has a correction amount calculating section that calculates a correction amount of a level of intervention indicating a degree at which the machine control intervenes in an operation of the work implement instructed through the operation of the operation device based on an operation amount of the level-of-intervention input device, and the machine control section executes the machine control to intervene in the operation of the work implement instructed through the operation of the operation device at a level of intervention corrected based on the correction amount calculated at the correction amount calculating section.

Advantages of the Invention

According to the present invention, it becomes possible to adjust and maintain the pressing force at the time of slope-tamping by a work machine having a machine control function.

MODES FOR CARRYING OUT THE INVENTION

Hereinafter, an embodiment of the present invention is explained using the drawings. Note that although a hydraulic excavator provided with a bucket 10 as an attachment to the tip of a work implement is illustrated as an example hereinbelow, the present invention may be applied to a hydraulic excavator provided with an attachment other than a bucket. Furthermore, the present invention can be applied to a work machine other than a hydraulic excavator as long as such a work machine has an articulated work implement that is constituted by coupling a plurality of driven members (attachment, arm, boom, etc.) and moves on a predetermined operation plane.

In addition, in this document, when the word "on," "above," or "below" is used in connection with terms that represent certain shapes (for example, a target surface, a controlled object surface, etc.), "on" means the "surface" of the certain shape, "above" means a "position higher than the surface" of the certain shape, and "below" means a "position lower than the surface" of the certain shape. In addition, although, in the following explanation, if there are a plurality of identical constituent elements, alphabets are given at the ends of signs (numbers) in some cases, the alphabets are omitted, and the plurality of constituent elements are denoted collectively in some cases. For example, if there are three pumps 300*a*, 300*b*, and 300*c*, these pumps are denoted collectively as the pump 300 in some cases.

<Basic Configuration>

Figure 1:
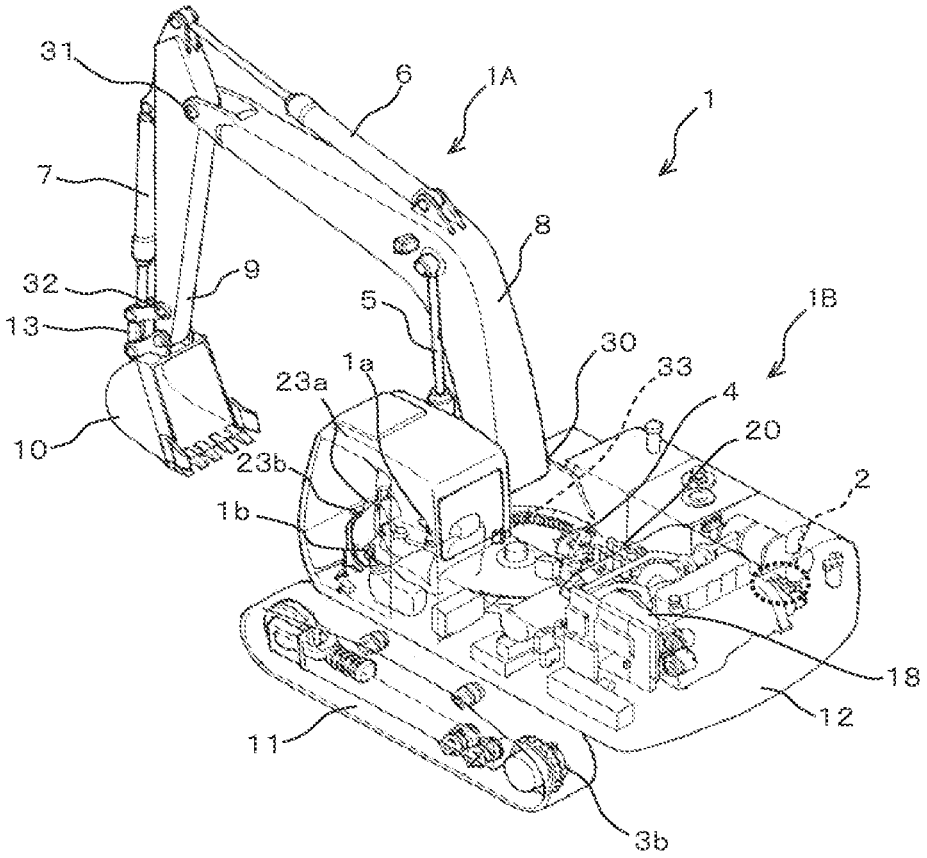
FIG. 1 is a configuration diagram of a hydraulic excavator according to an embodiment of the present invention.
Figure 2:
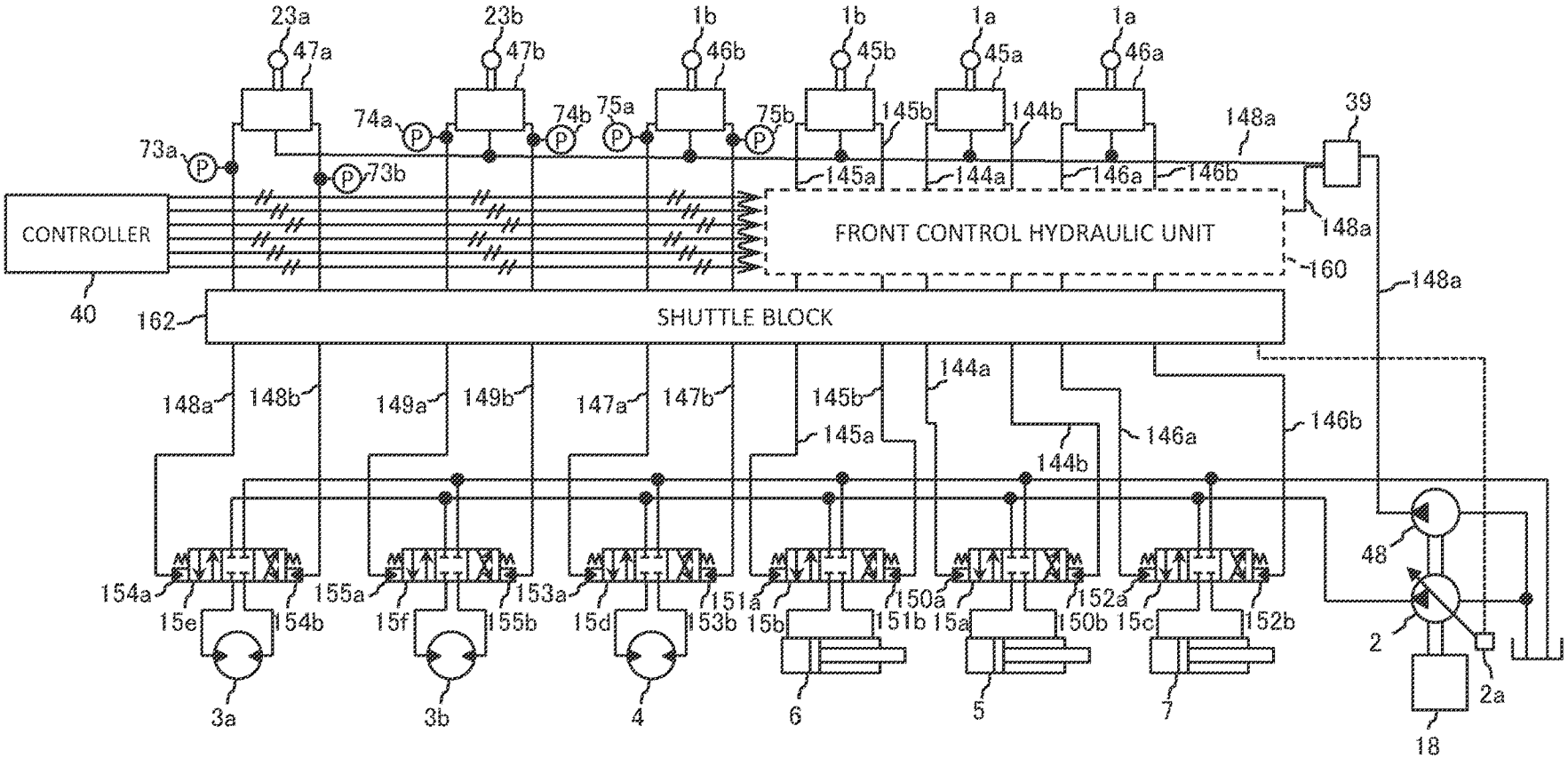
FIG. 2 is a figure illustrating a controller of the hydraulic excavator along with a hydraulic drive system.
Figure 3:
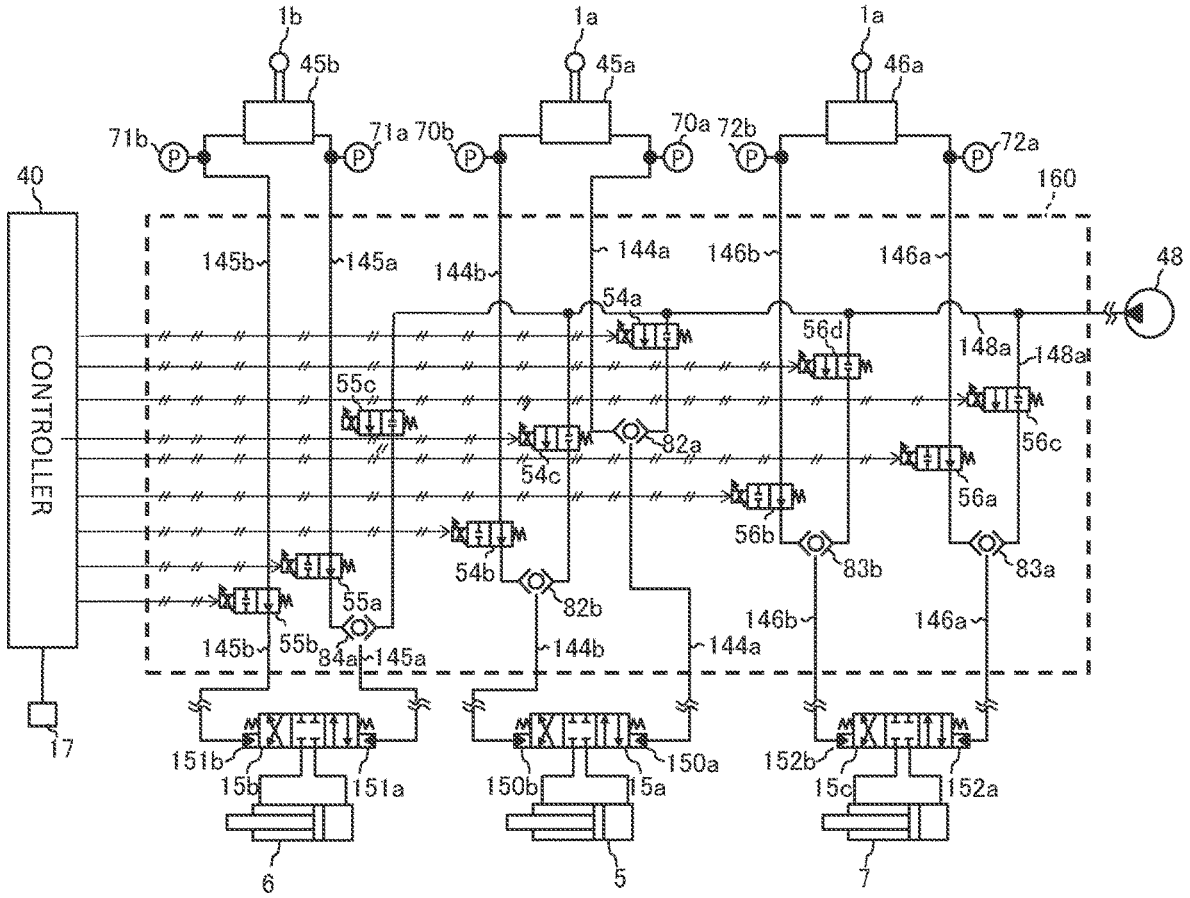
FIG. 3 is a detailed view of a front control hydraulic unit of the hydraulic excavator.

FIG. 1 is a configuration diagram of a hydraulic excavator according to an embodiment of the present invention. FIG. 2 is a figure illustrating a controller of the hydraulic excavator according to an embodiment of the present invention along with a hydraulic drive system. FIG. 3 is a detailed view of a front control hydraulic unit 160 in FIG. 2.

In FIG. 1, a hydraulic excavator 1 is constituted by an articulated front work implement 1A and a machine body 1B. The machine body 1B consists of a lower travel structure 11 that travels using left and right travel motors 3*a* and 3*b*, and an upper swing structure 12 attached swingably onto the lower travel structure 11. The front work implement 1A is constituted by coupling a plurality of driven members (a boom 8, an arm 9, and a bucket 10) that revolve individually in the vertical direction, and the base end of the boom 8 of the front work implement 1A is supported at a front section of the upper swing structure 12.

An engine 18 which is a prime mover mounted on the upper swing structure 12 drives a hydraulic pump 2 and a pilot pump 48. The hydraulic pump 2 is a variable displacement pump, the displacement of which is controlled by a regulator 2*a*, and the pilot pump 48 is a fixed displacement pump. In the present embodiment, a shuttle block 162 is provided in pilot lines 144, 145, 146, 147, 148, and 149. A hydraulic signal output from each of operation devices 45, 46, and 47 to instruct the front work implement 1A on an operation according to operation by an operator are input also to the regulator 2*a* via this shuttle block 162. Although the detailed configuration of the shuttle block 162 is omitted, hydraulic signals are input to the regulator 2*a* via the shuttle block 162, and the delivery rate of the hydraulic pump 2 is controlled according to the hydraulic signals.

A pump line 148*a* which is a delivery conduit of the pilot pump 48 passes through a lock valve 39, and then branches off into a plurality of conduits to be connected to the operation devices 45, 46, and 47 and individual valves in the front control hydraulic unit 160. The lock valve 39 is a solenoid selector valve in the present example, and its solenoid drive section is electrically connected with a position sensor of a gate lock lever (not illustrated) placed in a cabin (FIG. 1). The position of the gate lock lever is sensed at the position sensor, and a signal corresponding to the position of the gate lock lever is input from the position sensor to the lock valve 39. If the position of the gate lock lever is at the lock position, the lock valve 39 is closed, and the pump line 148*a* is blocked. If the position of the gate lock lever is at the unlock position, the lock valve 39 is opened, and the pump line 148*a* becomes unblocked. That is, in the state where the pump line 148*a* is blocked, operation by the operation devices 45, 46, and 47 is disabled, and an operation such as swinging or excavation is not allowed.

The boom 8, arm 9, bucket 10, and upper swing structure 12 constitute driven members driven by a boom cylinder 5, an arm cylinder 6, a bucket cylinder 7, and a swing hydraulic motor 4 (hydraulic actuator), respectively. Instructions about operations to these driven members 8, 9, 10, and 12 are output according to operation by an operator of a travel right lever 23*a*, a travel left lever 23*b*, an operation right lever 1*a*, and an operation left lever 1*b* (these are collectively referred to as operation levers 1 and 23 in some cases) mounted in the cabin on the upper swing structure 12.

In the cabin, an operation device 47*a* having the travel right lever 23*a*, an operation device 47*b* having the travel left lever 23*b*, operation devices 45*a* and 46*a* sharing the operation right lever 1*a*, and operation devices 45*b* and 46*b* sharing the operation left lever 1*b* are installed. The travel levers 23*a* and 23*b*, and the operation levers 1*a* and 1*b* are gripping sections on which hands of an operator is placed during operation of the excavator. The operation devices 45, 46, and 47 are hydraulic pilot operation devices, and, based on a hydraulic fluid delivered from pilot pumps, generate pilot pressure (referred to as operation pressure) corresponding to operation amounts (for example, lever strokes), and operation directions of the operation levers 1 and 23 individually operated by an operator. The thus-generated pilot pressure is supplied to hydraulic drive sections 150*a* to 155*b* of corresponding flow control valves 15*a* to 15*f* (see FIG. 2) in a control valve unit 20 via pilot lines 144*a* to 149*b* (see FIG. 2), and is utilized as control signals to drive these flow control valves 15*a* to 15*f*.

A hydraulic fluid delivered from the hydraulic pump 2 is supplied to the travel right hydraulic motor 3*a*, travel left hydraulic motor 3*b*, swing hydraulic motor 4, boom cylinder 5, arm cylinder 6, and bucket cylinder 7 via the flow control valves 15*a*, 15*b*, 15*c*, 15*d*, 15*e*, and 15*f* (see FIG. 2). With extension and contraction of the boom cylinder 5, arm cylinder 6, and bucket cylinder 7 caused by the supplied hydraulic fluid, the boom 8, arm 9, and bucket 10 revolve individually, and the position and posture of the bucket 10 change. In addition, with rotation of the swing hydraulic motor 4 caused by the supplied hydraulic fluid, the upper swing structure 12 swings relative to the lower travel structure 11. Furthermore, with rotation of the travel right hydraulic motor 3*a*, and travel left hydraulic motor 3*b* caused by the supplied hydraulic fluid, the lower travel structure 11 travels.

On the other hand, a boom angle sensor 30, an arm angle sensor 31, and a bucket angle sensor 32 are attached to a boom pin, an arm pin and a bucket link 13, respectively, so that the revolving angles α, β, and γ (see FIG. 5) of the boom 8, arm 9, and bucket 10 can be measured, and a machine body inclination angle sensor 33 to sense an inclination angle θ (see FIG. 5) in the forward/backward directions of the upper swing structure 12 (machine body 1B) relative to a reference plane (horizontal plane, for example) is attached to the upper swing structure 12.

For the purpose of assisting excavating operation of an operator, the hydraulic excavator in the present embodiment is provided with a control system that executes machine control for moving the front work implement 1A following a predetermined condition during operation of the operation devices 45*a*, 45*b*, and 46*c*, with a different operation than an operation as instructed through operation of the operation devices. Specifically, an excavation control system is provided, which, if excavating operation (specifically, an instruction about at least one of arm crowding, bucket crowding, and bucket dumping) is input via the operation devices 45*b* and 46*a*, outputs, to a corresponding flow control valve 15*a*, 15*b*, or 15*c*, a control signal for forcibly moving at least one of hydraulic actuators 5, 6, and 7 (for example, for forcibly performing a boom raising operation by extending the boom cylinder 5) such that the position of the tip of the work implement 1A (which is supposed to be the toe of the bucket 10 in the present embodiment) is kept in an area on and above a target surface 60 (see FIG. 5), based on the positional relationship between the target surface 60 and the tip of the work implement 1A. In this document, this control is referred to as "area limiting control" or "machine control" in some cases. Since this control prevents the toe of the bucket 10 from entering below the target surface 60, excavation along the target surface 60 becomes possible irrespective of the level of operator skill. In the present embodiment, the point of control related to the area limiting control is set to the toe of the bucket 10 of the hydraulic excavator (the tip of the work implement 1A). The point of control can be changed to a point other than the bucket toe as long as the point is at the tip portion of the work implement 1A. For example, the bottom surface of the bucket 10 or the outermost portion of the bucket link 13 can also be selected.

<Switch 17, Input Device 96, and Display Device 53>

The excavation control system that can execute the area limiting control (machine control) includes: a display device (for example, a liquid crystal display) 53 that is installed in the cabin, and can display the positional relationship between the target surface 60 and the work implement 1A; a machine control ON/OFF switch 17 that is provided to an operation lever 1*a* and alternatively selects one of enabling and disabling of machine control; a level-of-intervention input device 96 (input device) that is provided to the operation lever 1*a*, and adjusts a level of machine control intervention in operator operation via the operation devices 45*a*, 45*b*, and 46*a* (operation levers 1*a* and 1*b*); and a controller (control device) 40 which is a computer that can execute machine control. Here, a "level of intervention" indicates a degree of machine control intervention in an operation of the front work implement 1A instructed through operation of the operation devices.

Figure 8A:
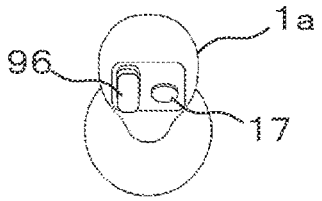
FIG. 8A is a top view of an operation lever provided with a level-of-intervention input device.
Figure 8B:
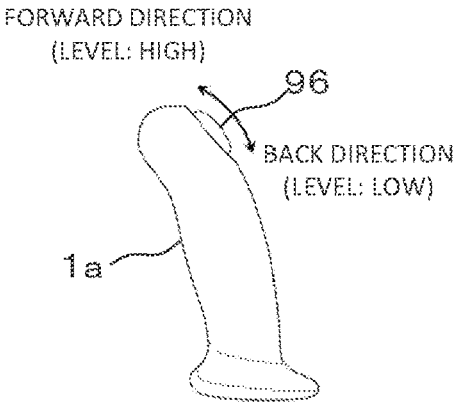
FIG. 8B is a side view of the operation lever provided with the level-of-intervention input device.
Figure 8C:
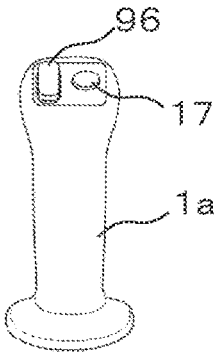
FIG. 8C is a front view of the operation lever provided with the level-of-intervention input device.

FIGS. 8A, B, and C are configuration diagrams of the operation lever 1*a* provided with the machine control ON/OFF switch 17, and the level-of-intervention input device 96 (input device). FIG. 8A is a top view of the operation lever 1*a*, FIG. 8B is a side view of the operation lever 1*a*, and FIG. 8C is a front view of the operation lever 1*a*.

The machine control ON/OFF switch 17 is provided at an upper end section on the front surface of the joystick-shaped operation lever 1*a*, and is pressed by a thumb of an operator who is gripping the operation lever 1*a*, for example. The machine control ON/OFF switch 17 is a momentary switch, and enabling and disabling of machine control are switched every time the machine control ON/OFF switch 17 is pressed. Note that a location at which the switch 17 is installed is not limited to the operation lever 1*a* (1*b*), but may be installed at another location.

The level-of-intervention input device 96 is provided next to the machine control ON/OFF switch 17, and is operated by a thumb of the operator who is gripping the operation lever 1*a* similar to the switch 17. The level-of-intervention input device 96 is an analog stick having a stick section that tilts in the forward direction and backward direction (see FIG. 8B) relative to a surface of the operation lever 1*a*, and outputs a tilt direction and a tilt amount of the stick section to the controller 40 (a machine control section 43). The position of the stick section illustrated in FIG. 8B is its initial position, and if the operator's hand is released from the stick section, the stick section returns to the initial position due to the urging force of an urging means (not illustrated) provided inside the lever. If the stick section is tilted in the forward direction, the level of intervention increases according to the tilt amount (operation amount) from the initial position, and if the stick section is tilted in the backward direction, the level of intervention decreases according to the tilt amount (operation amount) from the initial position.

<Front Control Hydraulic Unit 160>

As illustrated in FIG. 3, the front control hydraulic unit 160 includes: pressure sensors 70*a* and 70*b* (see FIG. 3) that are provided to the pilot lines 144*a* and 144*b* of the operation device 45*a* for the boom 8 and sense pilot pressure (a first control signal) as an operation amount of the operation lever 1*a*; a solenoid proportional valve 54*a* (see FIG. 3) that has a primary port side connected to the pilot pump 48 via the pump line 148*a*, and reduces and outputs the pilot pressure from the pilot pump 48; a shuttle valve 82*a* (see FIG. 3) that is connected to the pilot line 144*a* of the operation device 45*a* for the boom 8 and to a secondary port side of the solenoid proportional valve 54*a*, selects higher pressure of the pilot pressure in the pilot line 144*a* and control pressure (a second control signal) output from the solenoid proportional valve 54*a*, and guides the higher pressure to the hydraulic drive section 150*a* of the flow control valve 15*a*; a solenoid proportional valve 54*b* (see FIG. 3) that is installed in the pilot line 144*b* of the operation device 45*a* for the boom 8, reduces the pilot pressure (the first control signal) in the pilot line 144*b* based on a control signal from the controller 40, and outputs the reduced pressure; a solenoid proportional valve 54*c* (see FIG. 3) that has a primary port side connected to the pilot pump 48, and reduces and outputs the pilot pressure from the pilot pump 48; and a shuttle valve 82*b* (see FIG. 3) that selects higher pressure of the pilot pressure in the pilot line 144*b* and the control pressure output from the solenoid proportional valve 54*c*, and guides the higher pressure to the hydraulic drive section 150*b* of the flow control valve 15*a*.

In addition, the front control hydraulic unit 160 is provided with: pressure sensors 71*a* and 71*b* (see FIG. 3) that are installed in the pilot lines 145*a* and 145*b* for the arm 9, sense pilot pressure (a first control signal) as an operation amount of the operation lever 1*b*, and output the pilot pressure to the controller 40; a solenoid proportional valve 55*b* (see FIG. 3) that is installed in the pilot line 145*b*, reduces the pilot pressure (the first control signal) based on a control signal from the controller 40, and outputs the pilot pressure to a hydraulic drive section 151*b* of the flow control valve 15*b*; a solenoid proportional valve 55*a* (see FIG. 3) that is installed in the pilot line 145*a*, reduces the pilot pressure (the first control signal) in the pilot line 145*a* based on the control signal from the controller 40, and outputs the reduced pressure; a solenoid proportional valve 55*c* (see FIG. 3) that has a primary port side connected to the pilot pump 48, and reduces and outputs the pilot pressure from the pilot pump 48; and a shuttle valve 84*a* (see FIG. 3) that selects higher pressure of control pressure output from the solenoid proportional valve 55*a* and control pressure output from the solenoid proportional valve 55*c*, and guides the higher pressure to a hydraulic drive section 151*a* of the flow control valve 15*b*.

In addition, the front control hydraulic unit 160 is provided with: pressure sensors 72*a* and 72*b* (see FIG. 3) that are in the pilot lines 146*a* and 146*b* for the bucket 10, sense pilot pressure (a first control signal) as an operation amount of the operation lever 1*a*, and output the pilot pressure to the controller 40; solenoid proportional valves 56*a* and 56*b* (see FIG. 3) that reduce and output the pilot pressure (the first control signal) based on a control signal from the controller 40; solenoid proportional valves 56*c* and 56*d* (see FIG. 3) that have primary port sides connected to the pilot pump 48, and reduce and output the pilot pressure from the pilot pump 48; and shuttle valves 83*a* and 83*b* (see FIG. 3) that select higher pressure of control pressure output from the solenoid proportional valves 56*a* and 56*b* and control pressure output from the solenoid proportional valves 56*c* and 56*d*, and guide the higher pressure to hydraulic drive sections 152*a* and 152*b* of the flow control valve 15*c*. Note that connection lines between the pressure sensors 70, 71, and 72 and the controller 40 are omitted in FIG. 3 for want of space.

Opening degrees of the solenoid proportional valves 54*b*, 55*a*, 55*b*, 56*a*, and 56*b* become the largest when they are not powered, and the opening degrees decrease as current which is a control signal from the controller 40 increases. On the other hand, the opening degrees of the solenoid proportional valves 54*a*, 54*c*, 55*c*, 56*c*, and 56*d* become zero when they are not powered, and the solenoid proportional valves 54*a*, 54*c*, 55*c*, 56*c*, and 56*d* have opening degrees when they are powered. The opening degrees increase as the current (the control signal) from the controller 40 increases. In this manner, the opening degree 54, 55 or 56 of each solenoid proportional valve corresponds to the control signal from the controller 40.

In the thus-configured front control hydraulic unit 160, when a control signal is output from the controller 40 to drive the solenoid proportional valves 54*a*, 54*c*, 55*c*, 56*c*, and 56*d*, pilot pressure (a second control signal) can be generated even when there is no operator operation of the operation devices 45*a* and 46*a*; as a result, a boom raising operation, boom lowering operation, arm crowding operation, bucket crowding operation, or bucket dumping operation can be generated forcibly. In addition, when the solenoid proportional valves 54*b*, 55*a*, 55*b*, 56*a*, and 56*b* are similarly driven by the controller 40, the pilot pressure (the second control signal) obtained by subtraction from pilot pressure (a first control signal) generated by operator operation of the operation devices 45*a*, 45*b*, and 46*a* can be generated; as a result, the speed of a boom lowering operation, arm crowding/dumping operation, or bucket crowding/dumping operation can be reduced forcibly as compared to speed operation by the operator.

In this document, pilot pressure which is generated by operation of the operation devices 45*a*, 45*b*, and 46*a* among control signals for the flow control valves 15*a* to 15*c* is referred to as a "first control signal." Then, pilot pressure which is produced by driving the solenoid proportional valves 54*b*, 55*a*, 55*b*, 56*a*, and 56*b* with the controller 40 to correct (lower) the first control signal among the control signals for the flow control valves 15*a* to 15*c*, and pilot pressure produced newly and separately from the first control signal by driving the solenoid proportional valves 54*b*, 55*a*, 55*b*, 56*a*, and 56*b* with the controller 40 are referred to as "second control signals."

As mentioned below in detail, the second control signals are produced when a speed vector of the tip of the work implement 1A generated by the first control signal is not within a predetermined limit, and are produced as control signals that generate the speed vector of the tip of the work implement 1A within the predetermined limit. Note that if a first control signal is produced for one hydraulic drive section of a particular flow control valve 15*a*, 15*b* or 15*c*, and a second control signal is produced for the other hydraulic drive section of the particular flow control valve 15*a*, 15*b* or 15*c*, the effect of the second control signal on the hydraulic drive section is prioritized, the first control signal is blocked at the corresponding solenoid proportional valve, and the second control signal is input to the other hydraulic drive section. Accordingly, among the flow control valves 15*a* to 15*c*, a flow control valve for which a second control signal is calculated is controlled based on the second control signal, a flow control valve for which a second control signal is not calculated is controlled based on the first control signal, and a flow control valve for which none of the first and second control signals are generated is not controlled (not driven). According to the thus-defined first control signal and second control signal, the above-mentioned "area limiting control" or "machine control" can be seen as control of the flow control valves 15*a* to 15*c* based on the second control signals.

<Controller 40>

Figure 4:
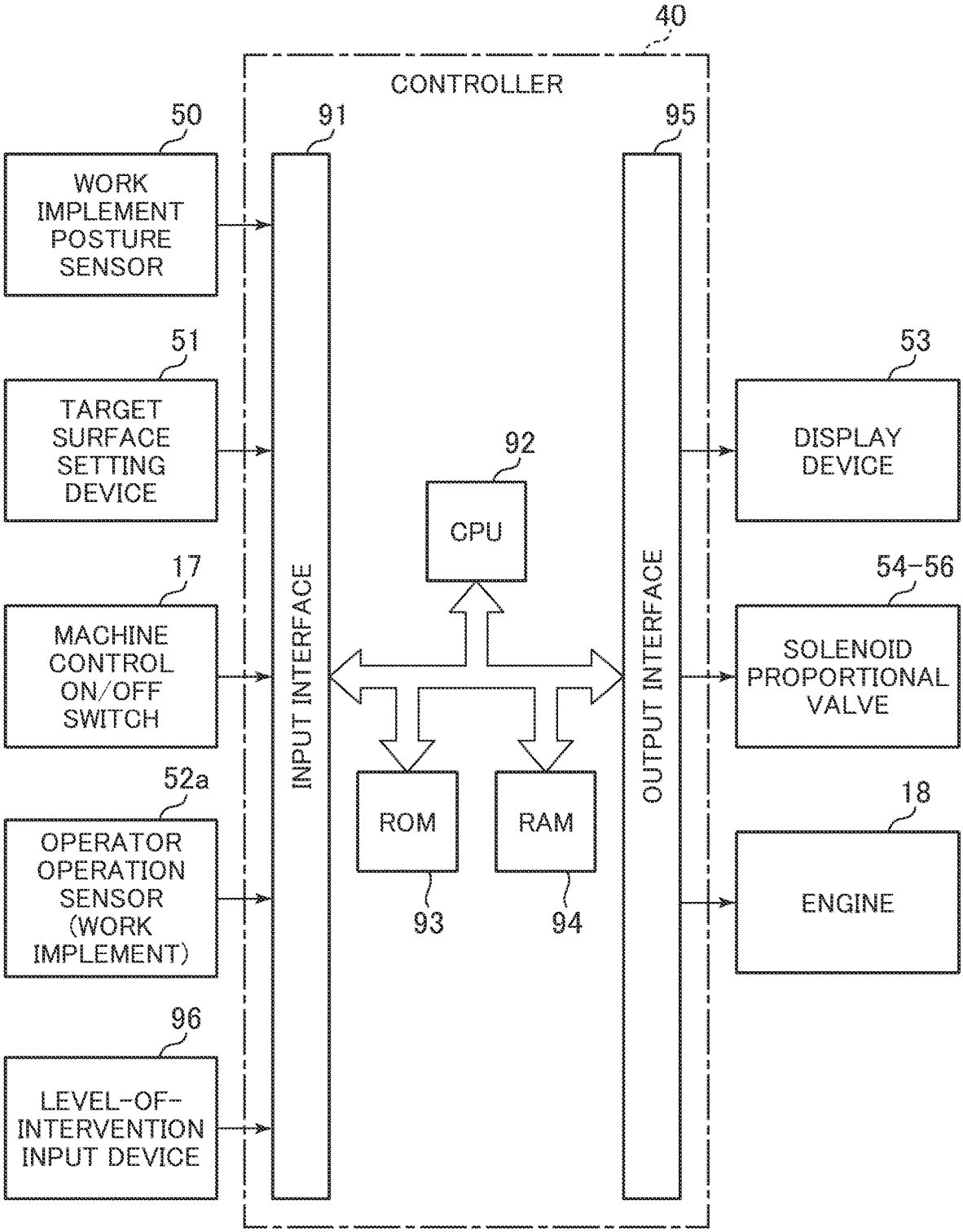
FIG. 4 is a hardware configuration diagram of the controller of the hydraulic excavator.

FIG. 4 illustrates a hardware configuration of the controller 40. The controller 40 has an input section 91, a central processing unit (CPU) 92 which is a processor, a read-only memory (ROM) 93 and a random-access memory (RAM) 94 which are storage devices, and an output section 95. The input section 91 receives inputs of: signals from the angle sensors 30 to 32 and inclination angle sensor 33 which constitute a work implement posture sensor 50; a signal from a target surface setting device 51 which is a system for setting a given target surface 60; a signal from the machine control ON/OFF switch 17; a signal from an operator operation sensor 52*a* which includes pressure sensors (the pressure sensors 70, 71, and 72) to sense operation amounts from the operation devices 45*a*, 45*b*, and 46*a*; and a signal from the level-of-intervention input device 96, and converts the signals so that the CPU 92 can perform calculation. The ROM 93 is a recoding medium storing a control program for executing area limiting control including processes according to a flowchart mentioned below, various types of information required for execution of the flowchart, and the like. The CPU 92 performs a predetermined calculation process on signals received from the input section 91 and the memories 93 and 94 following the control program stored in the ROM 93. The output section 95 creates a signal to be output corresponding to a result of the calculation at the CPU 92, and outputs the signal to the solenoid proportional valves 54 to 56 or display device 53 to thereby drive/control the hydraulic actuators 5 to 7, displays, on a display screen of a monitor which is the display device 53, an image of the machine body 1B, the bucket 10, the target surface 60 or the like.

Note that although the controller 40 in FIG. 4 includes semiconductor memories, which are referred to as the ROM 93 and RAM 94, as storage devices, such storage devices can be replaced without particularly limiting to the semiconductor memories. For example, the controller 40 may include a magnetic storage device such as a hard disk drive.

Figure 6:
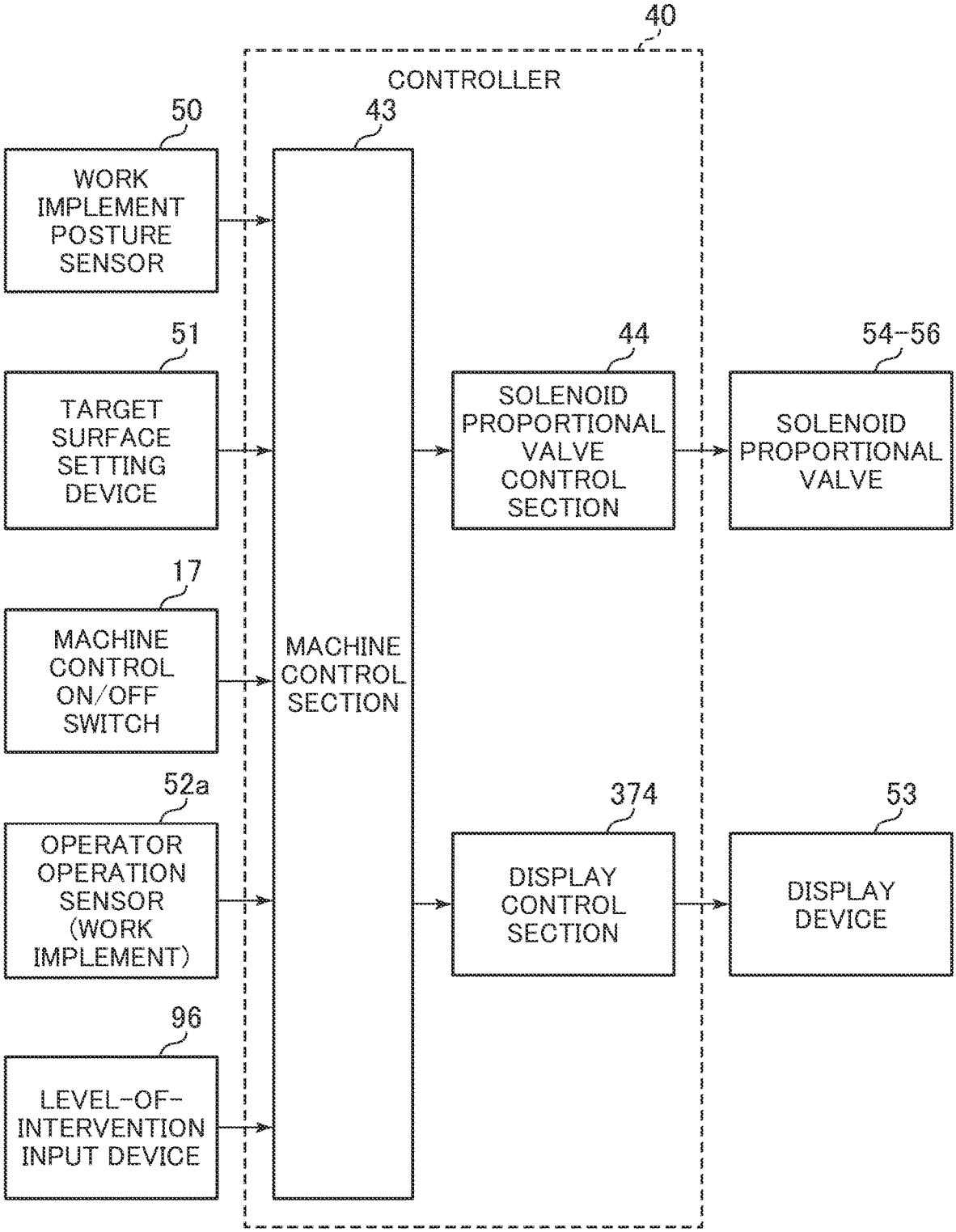
FIG. 6 is a functional block diagram of the controller of the hydraulic excavator.

FIG. 6 is a functional block diagram of the controller 40 according to an embodiment of the present invention. The controller 40 includes the machine control section 43, a solenoid proportional valve control section 44, and a display control section 374.

The work implement posture sensor 50 is constituted by the boom angle sensor 30, the arm angle sensor 31, the bucket angle sensor 32, and the machine body inclination angle sensor 33.

The target surface setting device 51 is an interface through which information about the target surface 60 (including positional information or inclination angle information about each target surface) can be input. Inputting of a target surface via the target surface setting device 51 may be performed manually by an operator, or such inputs may be received from the outside via a network or the like. In addition, a satellite communication antenna (not illustrated) such as a GNSS receiver is connected to the target surface setting device 51. If an external terminal storing three-dimensional data about a target surface defined in a global coordinate system (absolute coordinate system) and an excavator can perform data communication, a target surface corresponding to the excavator position can be searched in the three-dimensional data in the external terminal and received, based on the global coordinate of the excavator identified by the satellite communication antenna.

The operator operation sensor 52*a* is constituted by the pressure sensors 70*a*, 70*b*, 71*a*, 71*b*, 72*a*, and 72*b* that acquire operation pressure (a first control signal) generated in the pilot lines 144, 145, and 146 by operation of the operation levers 1*a* and 1*b* (operation devices 45*a*, 45*b*, and 46*a*) by an operator. That is, operation of the hydraulic cylinders 5, 6, and 7 related to the work implement 1A is sensed.

<Display Device>

The display control section 374 is a section that controls the display device 53 based on information about a work implement posture, a target surface, a machine control ON/OFF state, and a level of machine control intervention in operator operation that are output from the machine control section 43. The display control section 374 is provided with a display ROM storing a number of pieces of display-related data including icons, and the display control section 374 reads out a predetermined program based on a flag included in input information, and additionally performs display control of the display device 53.

Figure 15:
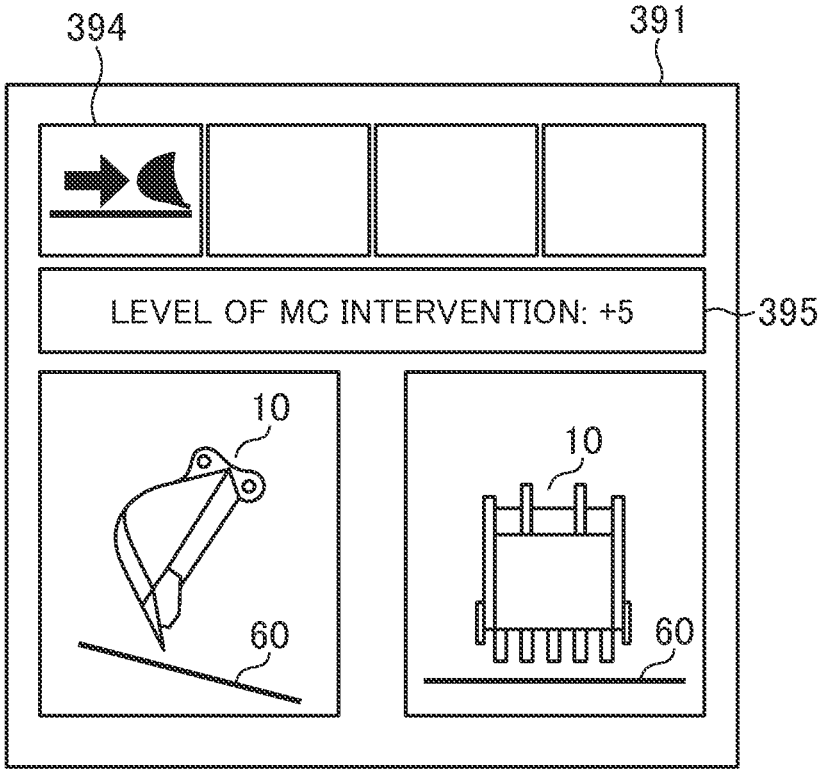
FIG. 15 is a figure illustrating an example of display contents of a display device.

Specifically, the display control section 374 displays, on a display section 395, a level of intervention (a degree of a change in a limiting value ay made by the level-of-intervention input device 96) based on a tilt direction and a tilt amount of the stick section of the level-of-intervention input device 96, as illustrated in FIG. 15. In the example illustrated in FIG. 12, the numerical value of a level of intervention on the display section 395 is changed in proportion to a tilt amount (operation amount) of the stick section. A level of intervention in a case where the stick section is tilted in the forward direction to increase the level of intervention is displayed as a positive (+) level of intervention, and a level of intervention in a case where the stick section is tilted in the backward direction to reduce the level of intervention is displayed as a negative (−) level of intervention. The level of intervention displayed on the display section 395 may not only be numerical values as illustrated as an example in FIG. 15, but a meter display or the like indicating the level may also be utilized.

In addition, if information indicating that the machine control ON/OFF state is ON is input from the machine control section 43, the display control section 374 displays, on the display screen 391, an icon 393 indicating that the machine control ON/OFF state is ON. On the other hand, if information indicating that the machine control ON/OFF state is OFF is input, the display control section 374 does not display an icon 394 on the display screen 391. Based on information about a work implement posture and a target surface, the display screen 391 in FIG. 15 displays a longitudinal cross-sectional view of the target surface 60 (a side view of the bucket 10) and a lateral cross-sectional view of the target surface 60 at the toe position of the bucket 10 for notifying an operator of the positional relationship between the target surface 60 and the bucket 10.

<Machine Control Section 43 and Solenoid Proportional Valve Control Section 44>

Figure 7:
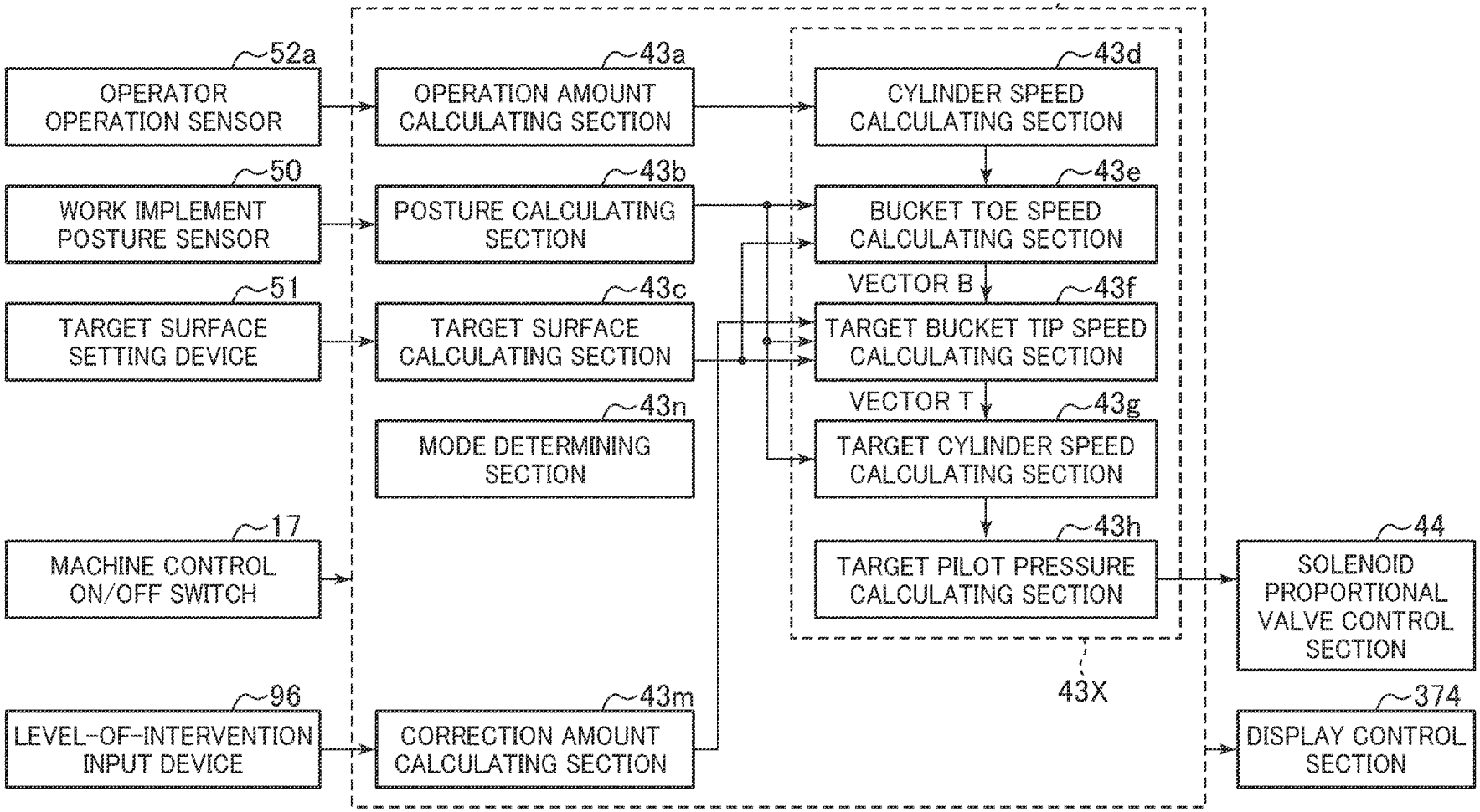
FIG. 7 is a functional block diagram of a machine control section in FIG. 6.

FIG. 7 is a functional block diagram of the machine control section 43 in FIG. 6. The machine control section 43 executes machine control to move the front work implement 1A following a predetermined condition at the time of operation of the operation devices 45*a*, 45*b*, and 46*c*. The machine control section 43 includes an operation amount calculating section 43*a*, a posture calculating section 43*b*, a target surface calculating section 43*c*, a cylinder speed calculating section 43*d*, a bucket toe speed calculating section 43*e*, a target bucket toe speed calculating section 43*f*, a target cylinder speed calculating section 43*g*, a target pilot pressure calculating section 43*h*, a correction amount calculating section 43*m*, and a mode determining section 43*n*. Among them, the cylinder speed calculating section 43*d*, bucket toe speed calculating section 43*e*, target bucket toe speed calculating section 43*f*, target cylinder speed calculating section 43*g*, and target pilot pressure calculating section 43*h* are collectively referred to as a "control signal calculating section 43X" in some cases.

The operation amount calculating section 43*a* calculates operation amounts of the operation devices 45*a*, 45*b*, and 46*a* (operation levers 1*a* and 1*b*) based on inputs from the operator operation sensor 52*a*. The operation amounts of the operation devices 45*a*, 45*b*, and 46*a* can be calculated from sensing values from the pressure sensors 70, 71, and 72.

Note that the calculation of operation amounts by the pressure sensors 70, 71, and 72 is merely one example, and the operation amounts of the operation levers of the individual operation devices 45*a*, 45*b*, and 46*a* may be sensed by positional sensors (for example, rotary encoders) that sense rotational displacement of the operation levers, for example.

Figure 5:
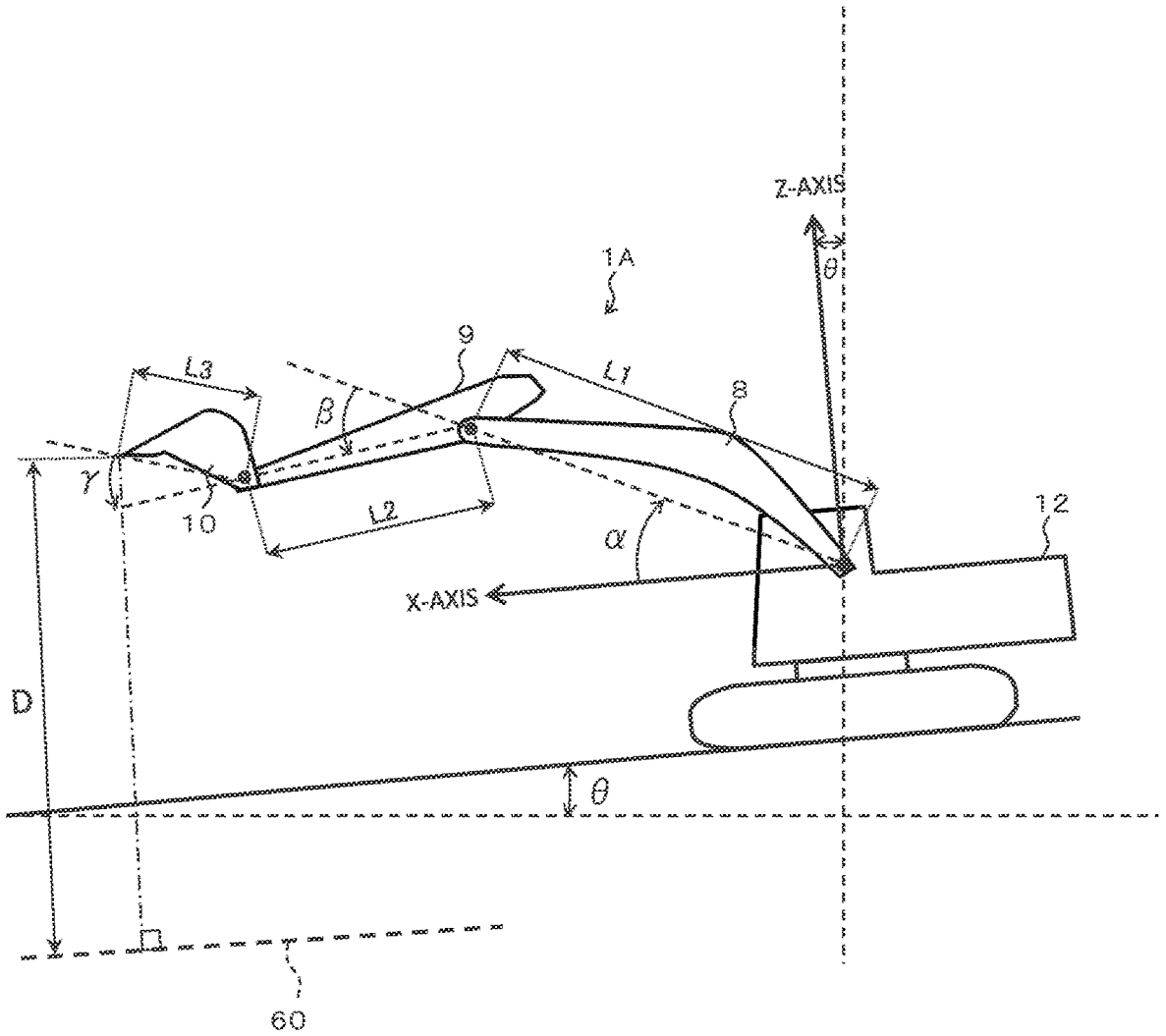
FIG. 5 is a figure illustrating a coordinate system in the hydraulic excavator and a target surface.

The posture calculating section 43*b* calculates the posture of the work implement 1A and the position of the toe of the bucket 10 based on information from the work implement posture sensor 50. The posture of the work implement 1A can be defined in an excavator coordinate system in FIG. 5. The excavator coordinate system in FIG. 5 is a coordinate system set for the upper swing structure 12, and has its origin at the base bottom section of the boom 8 supported pivotably by the upper swing structure 12, and has its Z-axis and X-axis in the vertical direction and horizontal direction, respectively, of the upper swing structure 12. The angle of inclination of the boom 8 to the X-axis is defined as a boom angle $\alpha$, the angle of inclination of the arm 9 to the boom 8 is defined as an arm angle $\beta$, and the angle of inclination of the bucket toe to the arm is defined as a bucket angle $\gamma$. The angle of inclination of the machine body 1B (upper swing structure 12) to the horizontal plane (reference plane) is defined as an inclination angle $\theta$. The boom angle $\alpha$ is sensed by the boom angle sensor 30, the arm angle $\beta$ is sensed by the arm angle sensor 31, the bucket angle $\gamma$ is sensed by the bucket angle sensor 32, and the inclination angle $\theta$ is sensed by the machine body inclination angle sensor 33. As defined in FIG. 5, if the lengths of the boom 8, arm 9, and bucket 10 are L1, L2, and L3, respectively, a coordinate of the bucket toe position and a posture of the work implement 1A in the excavator coordinate system can be expressed by L1, L2, L3, $\alpha$, $\beta$, and $\gamma$.

The target surface calculating section 43*c* calculates positional information of the target surface 60 based on information from the target surface setting device 51, and stores the positional information in the ROM 93. In the present embodiment, as illustrated in FIG. 5, the line of intersection along which the three-dimensional target surface crosses a plane on which the work implement 1A moves (plane on which the work implement moves) is utilized as the target surface 60 (a target line on a two-dimensional plane on which the work implement 1A moves).

The mode determining section 43*n* determines the mode of control signal calculation processes performed at the control signal calculating section 43X based on the positional relationship between the bucket toe and the target surface 60 obtained from a result of calculation at the posture calculating section 43*b* and target surface calculating section 43*c*, and contents of operation of the operation devices 45*b* and 46*a* input from the operation amount calculating section 43*a*. Control signal calculation modes include a "boom lowering deceleration mode" in which boom lowering operation by an operator is decelerated by machine control, and a "boom raising/lowering mode" in which the boom 8 is moved such that the bucket 10 is positioned on or above the target surface 60 by machine control. Specific contents of the mode determination processes by the mode determining section 43*n* are mentioned below with reference to FIG. 11, and specific contents of control signal calculation processes (pilot pressure calculation processes) in those two modes are also mentioned below with reference to FIGS. 12 and 14. Note that although control lines are not connected to the mode determining section 43*n* in FIG. 7, the operation amount calculating section 43*a*, posture calculating section 43*b*, target surface calculating section 43*c*, and control signal calculating section 43X are connected thereto.

Based on information about tilt directions and tilt amounts (operation directions and operation amounts) of the stick section input from the level-of-intervention input device 96, the correction amount calculating section 43*m* calculates a correction amount of a level of machine control intervention in operator operation. The correction amount calculating section 43*m* calculates a numerical value of the correction amount of the level of intervention in proportion to the tilt amount (operation amount) of the stick section. The sign of the correction amount of the level of intervention is positive (+) if the stick section is tilted in the forward direction to increase the level of intervention, and is negative (−) if the stick section is tilted in the backward direction to reduce the level of intervention. The correction amount of the level of intervention in the present embodiment has 10 stages for each of positive and negative correction amounts, but this is merely one example, and the number of stages may be increased or reduced in any desired manner. In addition, the signs of correction amounts of levels of intervention may be limited to either one of the positive and negative signs. At that time, the tilt direction of the stick section of the input device 96 may also be limited.

The cylinder speed calculating section 43*d* calculates an operation speed (cylinder speed) of each hydraulic cylinder 5, 6, or 7 based on an operation amount (a first control signal) calculated at the operation amount calculating section 43*a*. The operation speed of each hydraulic cylinder 5, 6, or 7 can be calculated from an operation amount calculated at the operation amount calculating section 43*a*, characteristics of the flow control valves 15*a*, 15*b*, and 15*c*, the cross-sectional area of each hydraulic cylinder 5, 6, or 7, a pump flow rate (delivery amount) obtained by multiplying the capacity (tilting angle) of the hydraulic pump 2 with the revolution speed, or the like.

The bucket toe speed calculating section 43*e* calculates a bucket toe (claw tip) speed vector B to result from operator operation (a first control signal) based on the operation speed of each hydraulic cylinder 5, 6, or 7 calculated at the cylinder speed calculating section 43*d*, and the posture of the work implement 1A calculated at the posture calculating section 43*b*. The bucket toe speed vector B can be decomposed into a component bx and a component by which are horizontal and vertical to the target surface 60, respectively, based on information about the target surface 60 input from the target surface calculating section 43*c*.

Figure 9:
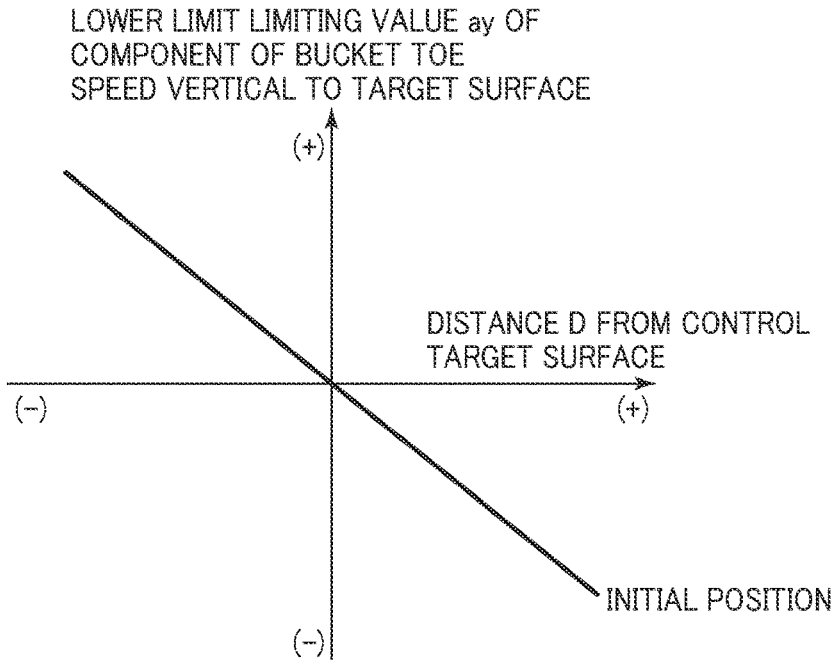
FIG. 9 is a figure illustrating a relationship between a limiting value ay for a vertical component of a bucket toe speed and distance D.

The target bucket toe speed calculating section 43*f* calculates a target speed vector T of the bucket toe (claw tip). In order to achieve this, the target bucket toe speed calculating section 43*f* first calculates a lower limit limiting value ay of a component vertical to the target surface 60 of the bucket toe speed vector based on the distance D (see FIG. 5) from the bucket toe to the target surface 60 to be controlled, and the graph in FIG. 9. Hereinafter, the "lower limit" of the lower limit limiting value ay is abbreviated to and referred to as a "limiting value ay." The limiting value ay can be referred, in other words, to as a maximum magnitude value of a vertical component from above the target surface 60 to the target surface 60 of the bucket toe speed vector. Calculation of the limiting value ay is performed by storing a relationship between the limiting value ay and the distance D in a format such as a function or a table which is defined as illustrated in FIG. 9 in advance in the ROM (storage device) 93 of the controller 40 and reading out the relationship when necessary. The distance D can be calculated from a distance between the position (coordinate) of the toe of the bucket 10 calculated at the posture calculating section 43*b*, and a straight line including the target surface 60 stored in the ROM 93. In the graph illustrated in FIG. 9, the limiting value ay is set for each distance D, and is set such that the absolute value of the limiting value ay decreases as the distance D approaches zero. If the stick section of the level-of-intervention input device 96 is at its initial position, the limiting value ay is decided based on the graph illustrated in FIG. 9. Note that the relationship between the limiting value ay and the distance D preferably has characteristics that the limiting value ay decreases monotonically as the distance D increases, but is not limited to the one illustrated in FIG. 9. For example, it may be set such that if the distance D is equal to or higher than a predetermined positive value or equal to or lower than a predetermined negative value, the limiting value ay is kept at a respectively different predetermined value, or the relationship between the limiting value ay and the distance D may be defined by a curve.

Figure 10:
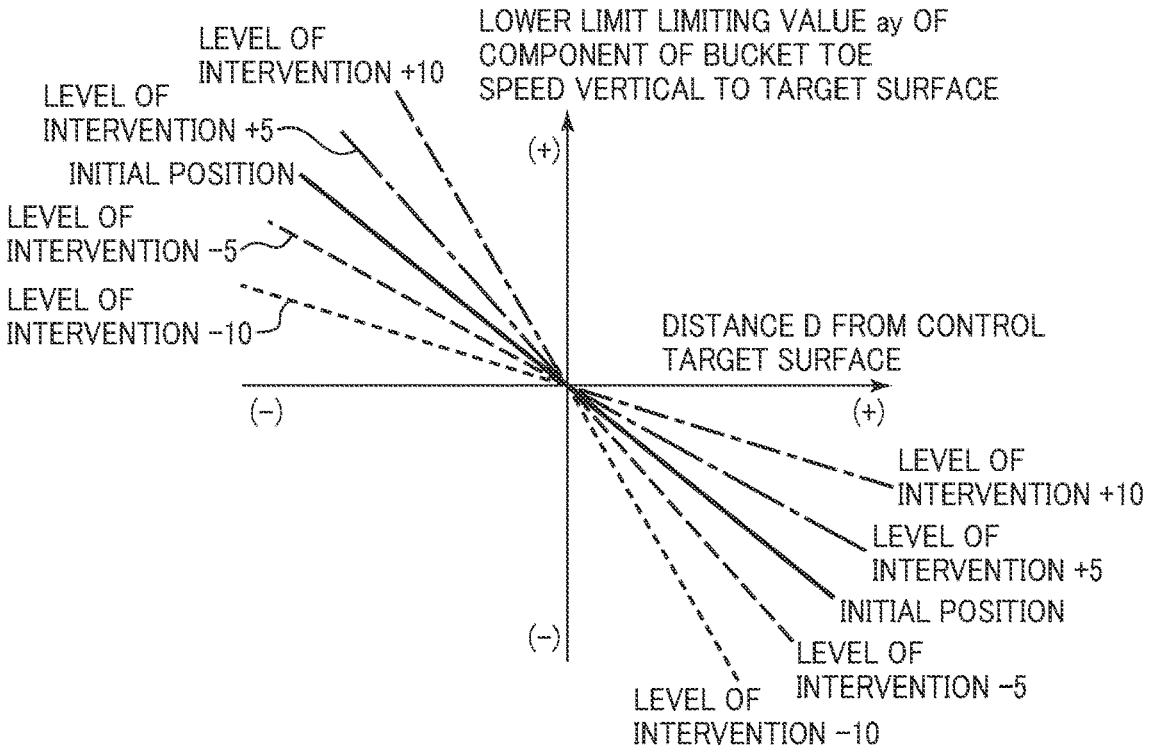
FIG. 10 is a figure illustrating a relationship among the limiting value ay, distance D and level of intervention.

Next, the target bucket toe speed calculating section 43*f* changes the relationship between the limiting value ay and the distance D based on a correction amount of the level of intervention input from the correction amount calculating section 43*m*, and thereby changes the limiting value ay for each particular distance D according to the correction amount of the level of intervention. Specifically, if the stick section of the level-of-intervention input device 96 is operated in the forward direction (one direction), the target bucket toe speed calculating section 43*f* changes the limiting value ay for each distance D to a value equal to or higher than the value corresponding to an initial position (that is, a degree of machine control intervention changes to be higher than a state corresponding to the initial position). On the contrary, if the level-of-intervention input device 96 is operated in the backward direction (the other direction), the target bucket toe speed calculating section 43*f* changes the limiting value ay for each distance D to a value equal to or lower than the value corresponding to the initial position (that is, a degree of machine control intervention changes to be lower than the state corresponding to the initial position). The limiting value ay in the present embodiment changes as indicated by a graph illustrated in FIG. 10 according to the level of intervention (the level of intervention corrected by a correction amount calculated from a tilt direction and a tilt amount of the input device 96). The limiting value ay is corrected to be larger along with a magnitude increase of the level of intervention if the level of intervention is positive, and is corrected to be smaller along with a magnitude increase of the level of intervention if the level of intervention is negative. In the example illustrated in FIG. 10, the distribution of the limiting value ay when the level of intervention is positive has a V-shape, and the distribution of the limiting value ay when the level of intervention is negative has an inverse V-shape. Note that although FIG. 10 illustrates a graph in which there are five stages of correction amounts of the level of intervention, −10, −5, 0, +5, and +10, it is needless to say that graphs with other stages are stored also. In addition, although in the example illustrated in FIG. 10, the respective limiting values ay of levels of intervention are distributed along a straight line or bent lines passing through the origin, they may be distributed along curves passing through the origin. In addition, the limiting value ay may be calculated directly from FIG. 10, bypassing FIG. 9.

Figure 12:
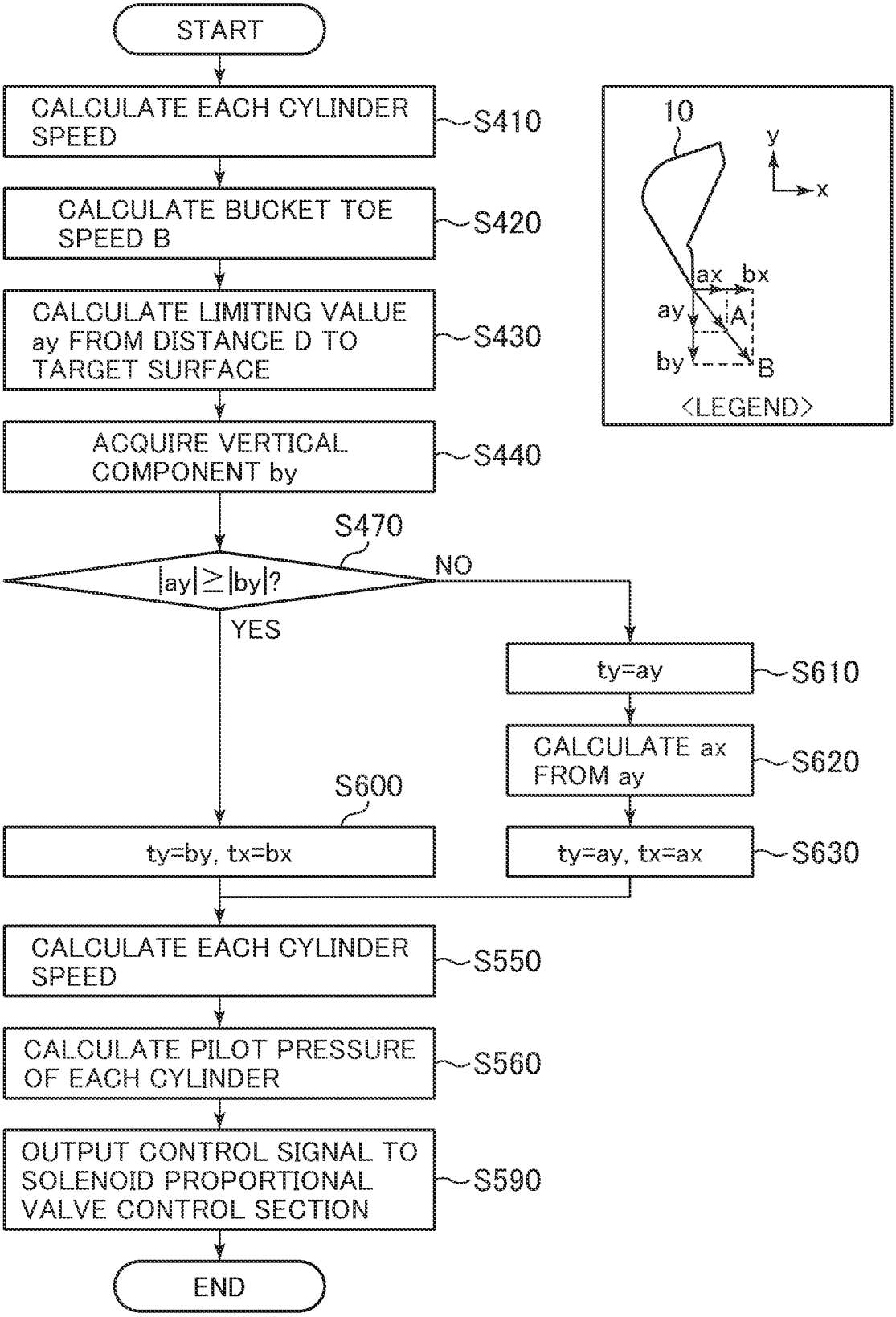
FIG. 12 is a flowchart of a boom lowering deceleration mode executed at a control signal calculating section of the controller.
Figure 14:
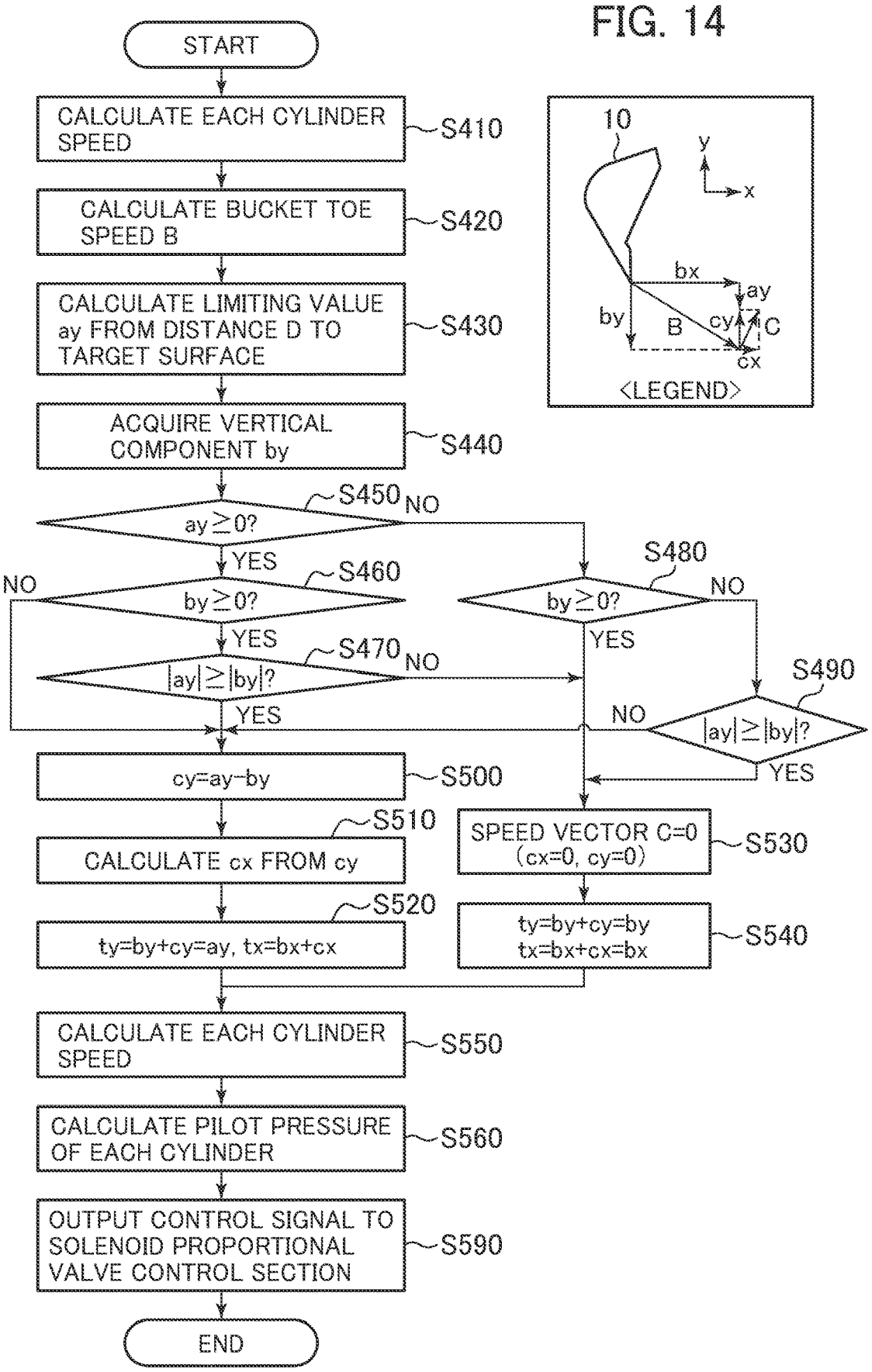
FIG. 14 is a flowchart of a boom raising/lowering mode executed at the control signal calculating section of the controller.

Furthermore, the target bucket toe speed calculating section 43*f* acquires the component by vertical to the target surface 60 of the bucket toe speed vector B, and selects a formula required for calculating the component cy vertical to the target surface 60 of a bucket toe speed vector C that should be generated by an operation of the boom 8 according to machine control, based on the vertical component by, whether the limiting value ay is positive or negative, and the magnitude relationship between absolute values of the vertical component by and the limiting value ay (a process of selecting the formula is mentioned below with reference to FIGS. 12, 14 and the like). Then, the vertical component cy is calculated based on the selected formula, the horizontal component cx is calculated based on an operation permitted for the boom at the time of generating the vertical component cy, and the target speed vector T is calculated from the speed vectors B and C and the limiting value ay. Hereinbelow, it is supposed that a component vertical to the target surface 60 of the target speed vector T is defined as ty, and a component horizontal to the target surface 60 of the target speed vector T is defined as tx, and the process of deriving the target vector T is also mentioned below with reference to FIGS. 12, 14 and the like.

The target cylinder speed calculating section 43*g* calculates a target speed of each hydraulic cylinder 5, 6, or 7 based on the target speed vector T (tx, ty) calculated at the target bucket toe speed calculating section 43*f*. In the present embodiment, since the target speed vector T is defined as the sum of the speed vector B to result from operator operation and the speed vector C to result from machine control, the target speed of the boom cylinder 5 can be calculated from the speed vector C. Thereby, the target speed vector T of the bucket toe becomes a composite value of the speed vectors that are observed at the bucket toe when each hydraulic cylinder 5, 6, or 7 is moved at the target speed.

The target pilot pressure calculating section 43*h* calculates target pilot pressure for the flow control valve 15*a*, 15*b* or 15*c* of each hydraulic cylinder 5, 6, or 7 based on the target speed of each cylinder 5, 6, or 7 calculated at the target cylinder speed calculating section 43*g*. Then, the calculated target pilot pressure of each hydraulic cylinder 5, 6, or 7 is output to the solenoid proportional valve control section 44.

The solenoid proportional valve control section 44 calculates a command to each solenoid proportional valve 54 to 56 based on the target pilot pressure for each flow control valve 15*a*, 15*b* or 15*c* calculated at the target pilot pressure calculating section 43*h*.

Note that if pilot pressure (a first control signal) based on operator operation and target pilot pressure calculated at the target pilot pressure calculating section 43*h* match, a current value (commanded value) for a corresponding solenoid proportional valve 54, 55 or 56 becomes zero, and the corresponding solenoid proportional valve 54, 55 or 56 is not moved.

<Flowchart of Machine Control>

[Mode Determination Process]

Figure 11:
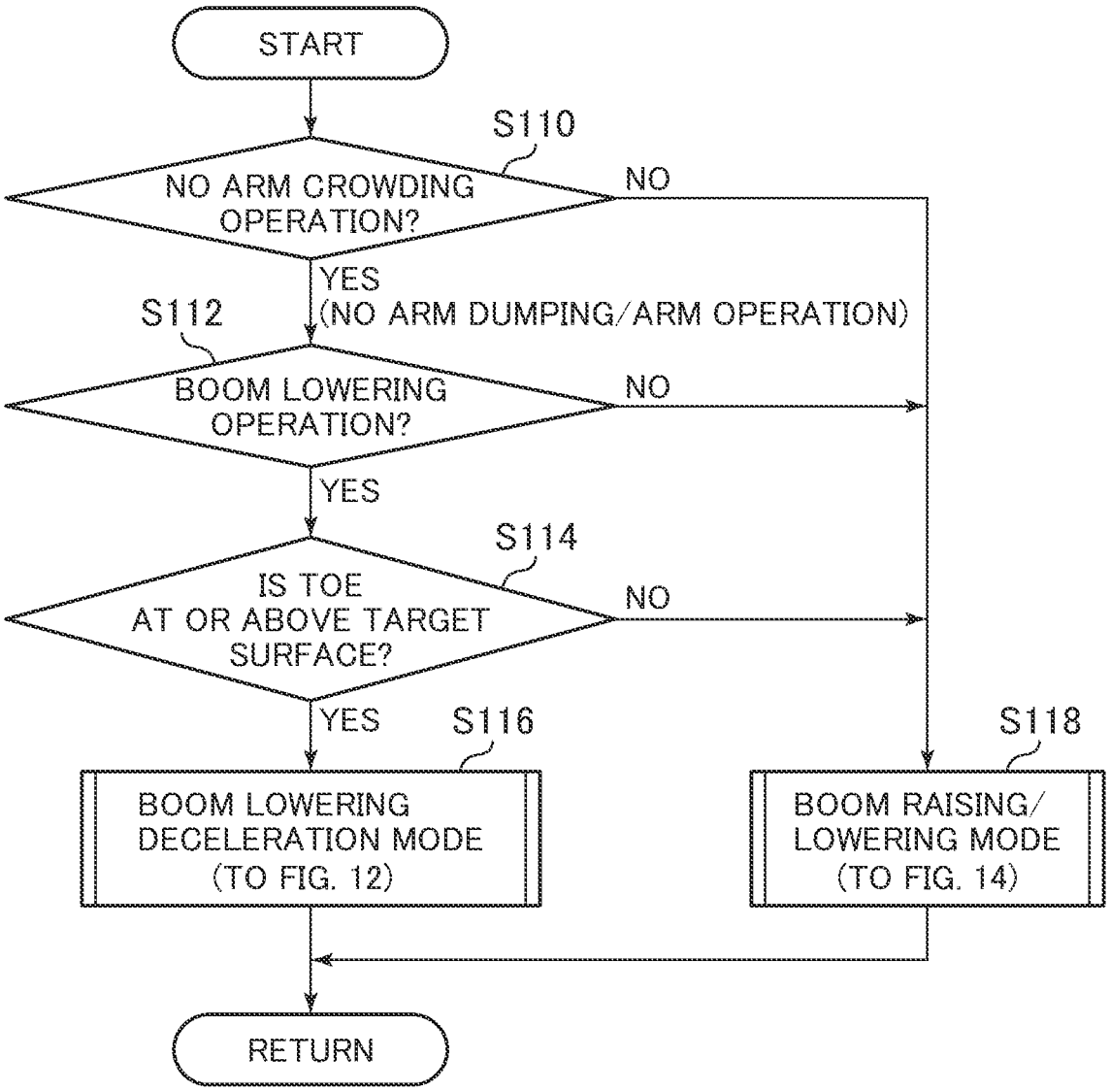
FIG. 11 is a flowchart of a mode determination process executed at a mode determining section of the controller.

FIG. 11 is a flowchart of a mode determination process executed at the mode determining section 43*n* of the controller 40. This flowchart is repeated in a predetermined control cycle while the power source of the hydraulic excavator 1 is turned on. In the flowchart illustrated in FIG. 11, the mode determining section 43*n* first determines at S110 whether or not there is arm crowding operation by an operator based on an input from the operation amount calculating section 43*a*. Here, if there is no arm crowding operation, the process proceeds to S112. On the other hand, if there is the arm crowding operation, the process proceeds to S118, and the boom raising/lowering mode illustrated in FIG. 14 is executed at the control signal calculating section 43X.

At S112, the mode determining section 43*n* determines whether or not there is boom lowering operation by an operator based on an input from the operation amount calculating section 43*a*. Here, if there is the boom lowering operation, the process proceeds to S114. On the other hand, if there is no boom lowering operation, the process proceeds to S118, and the boom raising/lowering mode is executed at the control signal calculating section 43X.

At S114, the mode determining section 43*n* determines whether or not the bucket toe is on or above the target surface 60 based on the posture of the work implement 1A input from the posture calculating section 43*b*, and positional information of the target surface 60 input from the target surface calculating section 43*c*. Here, if the toe is on or above the target surface 60, the process proceeds to S116, and the boom lowering deceleration mode illustrated in FIG. 12 is executed at the control signal calculating section 43X. On the other hand, if the toe is below the target surface 60, the process proceeds to S118, and the boom raising/lowering mode is executed at the control signal calculating section 43X.

After a lapse of a predetermined control cycle after S116 or S118 ends, the process returns to S110, and the same processes are repeated.

[Boom Lowering Deceleration Mode]

FIG. 12 is a flowchart of the boom lowering deceleration mode (S116 in FIG. 11) executed at the control signal calculating section 43X of the controller 40. If the process reached S116 in the flowchart illustrated in FIG. 11, the control signal calculating section 43X starts the flowchart illustrated in FIG. 12.

At S410, the cylinder speed calculating section 43*d* calculates the operation speed (cylinder speed) of each hydraulic cylinder 5, 6, or 7 based on an operation amount calculated at the operation amount calculating section 43*a*.

At S420, the bucket toe speed calculating section 43*e* calculates the bucket toe (claw tip) speed vector B to result from operator operation based on the operation speed of each hydraulic cylinder 5, 6, or 7 calculated at the cylinder speed calculating section 43*d*, and the posture of the work implement 1A calculated at the posture calculating section 43*b*.

At S430, the bucket toe speed calculating section 43*e* calculates a distance D (see FIG. 5) from the bucket toe to the target surface 60 to be controlled from the distance between a position (coordinate) of the toe of the bucket 10 calculated at the posture calculating section 43*b*, and a straight line including the target surface 60 stored in the ROM 93. Then, the bucket toe speed calculating section 43*e* calculates the limiting value ay of a component vertical to the target surface 60 of the bucket toe speed vector based on the distance D and the graph illustrated in FIG. 9. Furthermore, the bucket toe speed calculating section 43*e* calculates the limiting value ay based on a correction amount of the level of intervention input from the correction amount calculating section 43*m*, the graph illustrated in FIG. 10, and the distance D. Note that if a boom lowering deceleration mode is selected in the flowchart illustrated in FIG. 11, the distance D is positive (+), and in such a case, the limiting value ay becomes negative (−) based on FIG. 10.

At S440, the bucket toe speed calculating section 43*e* acquires a component by vertical to the target surface 60 in the bucket toe speed vector B calculated at S420 by operator operation.

At S470, the target bucket toe speed calculating section 43*f* compares absolute values of the limiting value ay and the vertical component by, and if the absolute value of the limiting value ay is equal to or larger than the absolute value of the vertical component by, the process proceeds to S600. On the other hand, if the absolute value of the limiting value ay is smaller than the absolute value of the vertical component by, the process proceeds to S610.

Since if the process proceeds to S600, the magnitude of the vertical component by of the speed vector B is equal to or smaller than the magnitude of the limiting value ay, it is not required to decelerate the speed vector B by machine control. That is, the target speed vector T in a case where the process reached S600 matches the speed vector B to result from operator operation. Accordingly, it is supposed that the components vertical and horizontal to the target surface 60 of the target speed vector T are ty and tx, they can be expressed as "ty=by, tx=bx."

On the other hand, since if the process proceeds to S610, a magnitude of the vertical component by of the speed vector B exceeds a magnitude of the limiting value ay, the vertical component of the speed vector B needs to be decelerated to the limiting value ay by machine control. In view of this, the target bucket toe speed calculating section 43*f* sets the vertical component ty of the target speed vector T to ay (S610). Then, the target bucket toe speed calculating section 43*f* calculates a speed vector A that can output the limiting value ay by deceleration of boom lowering by the machine control, and sets its horizontal component (ax) as the horizontal component tx of the target speed vector T (S620). As a result of S610 and S620, the target speed vector T results in "ty=ay, and tx=ax," after all (S630).

Note that the above-mentioned S610 to S630 are processes to be performed in a case where an orientation of the bucket toe speed vector to result from machine control is aligned with an orientation of the speed vector to result from operation by an operator. Additionally, the machine control may adopt a method of not intervening in a speed component in a direction parallel to a target surface. In this case, S610 and S620 are omitted, and ty is equal to ay, and tx is equal to bx at S630.

At S550, the target cylinder speed calculating section 43*g* calculates a target speed of each hydraulic cylinder 5 or 7 based on the target speed vector T (ty, tx) decided at S600 or S630. If the vertical component ty and horizontal component tx of the target speed vector T are ay and ax, respectively (that is, if S630 is passed), in the present embodiment, machine control is set not to intervene in operations (operation) of the arm and bucket, but intervene in a boom lowering operation to realize the target speed vector T. That is, at this time, a second control signal is calculated for the flow control valve 15*a* of the boom 8, but second control signals are not calculated for the flow control valves 15*b* and 15*c* of the arm 9 and bucket 10.

At S560, the target pilot pressure calculating section 43*h* calculates target pilot pressure for the flow control valve 15*a* or 15*c* of each hydraulic cylinder 5 or 7 based on the target speed of each cylinder 5 or 7 calculated at S550.

At S590, the target pilot pressure calculating section 43*h* outputs, to the solenoid proportional valve control section 44, the target pilot pressure for the flow control valve 15*a* or 15*c* of each hydraulic cylinder 5 or 7. The solenoid proportional valve control section 44 controls the solenoid proportional valves 54 and 56 such that the target pilot pressure acts on the flow control valve 15*a* or 15*c* of each hydraulic cylinder 5 or 7, and thereby a boom lowering operation including slope-tamping works is performed. In particular, if the process goes through S630, the vertical component ty of the target speed vector is limited to the limiting value ay, and deceleration of boom lowering by machine control is activated.

Figure 13:
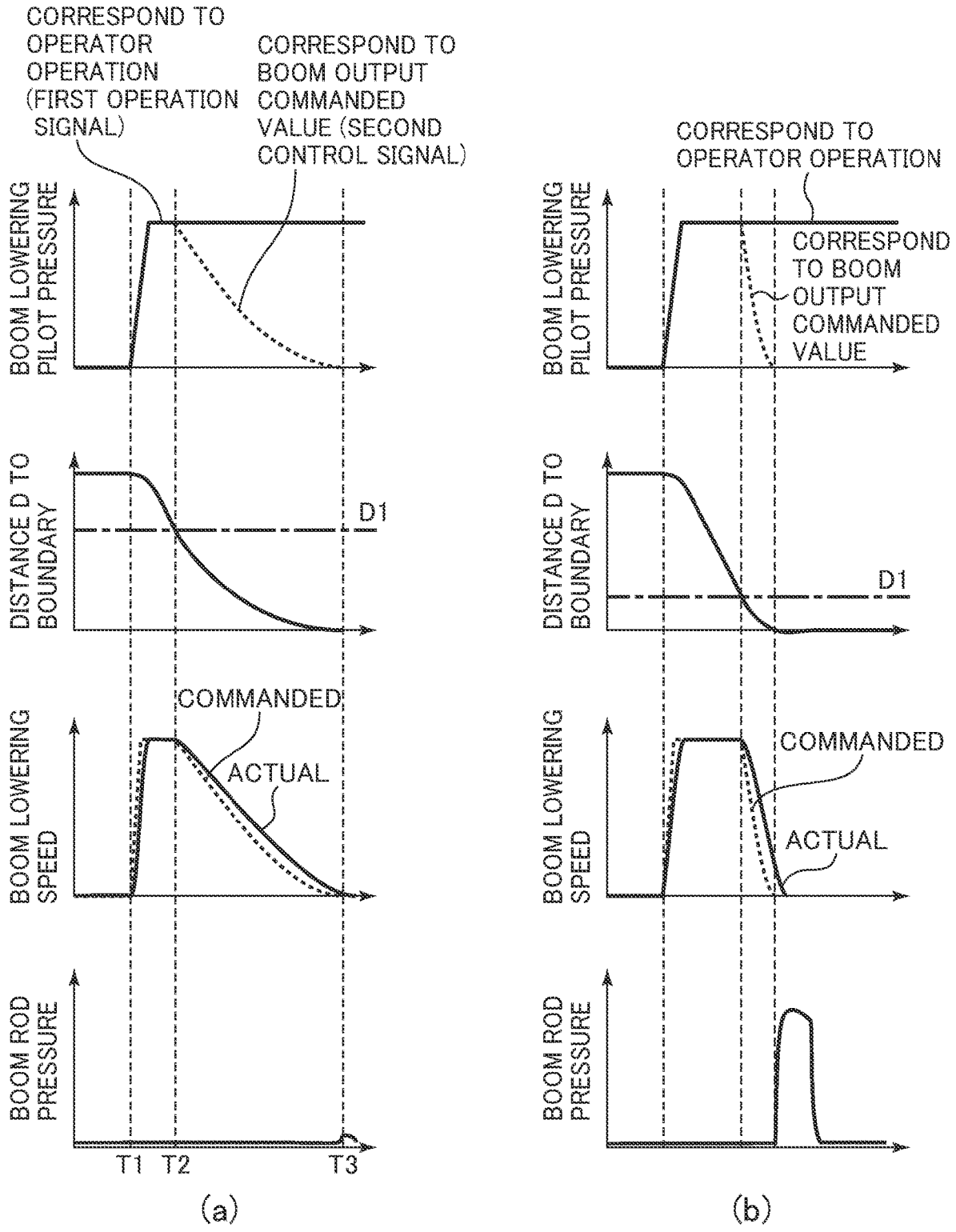
FIG. 13 is a comparison diagram of boom pilot pressure, the distance D, a boom speed and boom rod pressure in a case where the level of intervention is changed.

An operation to be performed in a case where slope-tamping works (horizontal plane compacting operations) are performed using the above-configured hydraulic excavator 1 is explained with reference to FIG. 13. FIG. 13(*a*) corresponds to an operation to be performed when the level of intervention is at its initial position, and FIG. 13(*b*) corresponds to an operation to be performed when the level of intervention is reduced (for example, −5). In either case, an operator performs boom lowering operation at the time T1, and the distance D to the target surface 60 decreases as the boom 8 is lowered. Thereafter, if the vertical component by of the speed vector B reaches the limiting value ay when the distance is D1 at the time T2, at and after the time T2, a boom lowering speed is limited by machine control, and if the distance D to the target surface 60 becomes 0 at the time T3, the boom lowering pilot pressure becomes 0.

If the level of intervention is a value of the initial position (reference value), as illustrated in FIG. 13(*a*), the distance D1 at which the boom lowering speed starts to be limited is relatively large, and the rate of change of the distance D is relatively low. In this case, as illustrated in the third graph, deviation of the commanded value of the boom lowering speed from the actual value is small, and the bucket 10 reaches the target surface 60 smoothly. Because of this, the degree of rising of boom rod pressure immediately after the time T3 is low.

On the other hand, if the level of intervention is set to be lower than the value of the initial position, as illustrated in FIG. 13(*b*), the distance D1 at which the boom lowering speed starts to be limited becomes relatively small, and the rate of change of the distance D becomes relatively high. In this case, deviation of the commanded value of the boom lowering speed from the actual value is large, and the boom lowering speed immediately before reaching the target surface 60 is high as compared with the case in FIG. 13(*a*). Because of this, the bucket 10 stops while colliding with the target surface 60, and the degree of rising of boom rod pressure immediately after the time T3 becomes high as compared with the case in FIG. 13(*a*).

That is, when the excavator controlled according to the flowchart illustrated in FIG. 12 is used, if the limiting value ay for each distance D is set smaller than the value of the initial position by changing a tilt amount of the level-of-intervention input device 96 in the backward direction, the bucket 10 can press the target surface 60 (that is, slope-tamping can be performed) by boom lowering even if the machine control ON/OFF switch 17 is turned on. Furthermore, the pressing force at that time can be adjusted by changing a tilt amount of the level-of-intervention input device 96 in the backward direction. In addition, by adjusting a level of machine control intervention utilizing the level-of-intervention input device 96 according to skills or preferences of an operator, effects of reducing man-hours and a mental burden can be attained.

[Boom Raising/Lowering Mode]

FIG. 14 is a flowchart of the boom raising/lowering mode (S118 in FIG. 11) executed at the control signal calculating section 43X of the controller 40. If the process reaches S118 in the flowchart illustrated in FIG. 11, the control signal calculating section 43X starts the flowchart illustrated in FIG. 14. Hereinbelow, explanations about the same processes as those in FIG. 12 are omitted, and S450 is explained first.

At S450, the target bucket toe speed calculating section 43*f* determines whether or not the limiting value ay calculated at S430 is equal to or larger than 0. Note that an x-y coordinate is set as illustrated at an upper right portion in FIG. 14. In the x-y coordinate, the x-axis has its positive direction in a direction parallel to the target surface 60 and in the rightward direction in the figure, and the y-axis has its positive direction in a direction vertical to the target surface 60 and in the upward direction in the figure. In the legend illustrated in FIG. 14, the vertical component by and limiting value ay are negative, and the horizontal component bx, horizontal component cx, and vertical component cy are positive. Then, as is obvious from FIGS. 9, and 10: if the limiting value ay is 0, the distance D is 0, that is, the toe is positioned on the target surface 60; if the limiting value ay is positive, the distance D is negative, that is, the toe is positioned below the target surface 60; and if the limiting value ay is negative, the distance D is positive, that is, the toe is positioned above the target surface 60. If the limiting value ay is determined as being equal to or larger than 0 at S450 (that is, the toe is positioned on or below the target surface 60), the process proceeds to S460, and if the limiting value ay is smaller than 0, the process proceeds to S480.

At S460, the target bucket toe speed calculating section 43*f* determines whether or not the vertical component by of the toe speed vector B to result from operator operation is equal to or larger than 0. A positive by indicates that the vertical component by of the speed vector B is pointing upward, and a negative by indicates that the vertical component by of the speed vector B is pointing downward. If it is determined at S460 that the vertical component by is equal to or larger than 0 (that is, the vertical component by is pointing upward), the process proceeds to S470, and if the vertical component by is smaller than 0, the process proceeds to S500.

At S470, the target bucket toe speed calculating section 43*f* compares absolute values of the limiting value ay and the vertical component by, and if the absolute value of the limiting value ay is equal to or larger than the absolute value of the vertical component by, the process proceeds to S500. On the other hand, if the absolute value of the limiting value ay is smaller than the absolute value of the vertical component by, the process proceeds to S530.

At S500, the target bucket toe speed calculating section 43*f* selects "cy=ay−by" as a formula to calculate the component cy vertical to the target surface 60 of the bucket toe speed vector C that should be generated by an operation of the boom 8 to result from machine control, and calculates the vertical component cy based on the formula, the limiting value ay calculated at S430, and the vertical component by acquired at S440. Then, the speed vector C of the boom 8 that can output the calculated vertical component cy only with an operation of the boom 8 is calculated based on a posture of the front work implement 1A at that time point, and the vertical component cy, and the horizontal component is set as cx (S510).

At S520, the target speed vector T is calculated. If it is supposed that the components vertical and horizontal to the target surface 60 of the target speed vector T are ty and tx, respectively, they can be expressed as "ty=by+cy, tx=bx+cx". If this is substituted into the formula selected at S500 (cy=ay−by), the target speed vector T can be expressed as "ty=ay, tx=bx+cx" after all. That is, the vertical component ty of the target speed vector in a case where the process reached S520 is limited to the limiting value ay, and forcible boom raising by machine control is activated.

At S480, the target bucket toe speed calculating section 43*f* determines whether or not the vertical component by of the toe speed vector B to result from operator operation is equal to or larger than 0. If it is determined at S480 that the vertical component by is equal to or larger than 0 (that is, the vertical component by is pointing upward), the process proceeds to S530, and if the vertical component by is smaller than 0, the process proceeds to S490.

At S490, the target bucket toe speed calculating section 43*f* compares absolute values of the limiting value ay and the vertical component by, and if the absolute value of the limiting value ay is equal to or larger than the absolute value of the vertical component by, the process proceeds to S530. On the other hand, if the absolute value of the limiting value ay is smaller than the absolute value of the vertical component by, the process proceeds to S500.

Since, if the process reaches S530, it is not required to move the boom 8 by machine control, the target bucket toe speed calculating section 43*f* sets the speed vector C to zero. In this case, the target speed vector T is expressed as "ty=by, tx=bx" based on the formulae (ty=by+cy, tx=bx+cx) utilized at S520, and matches the speed vector B to result from operator operation (S540).

At S550, the target cylinder speed calculating section 43*g* calculates a target speed of each hydraulic cylinder 5, 6, or 7 based on the target speed vector T (ty, tx) decided at S520 or S540. Note that, as is obvious from the above-mentioned explanation, if the target speed vector T does not match the speed vector B in the case illustrated in FIG. 14, the target speed vector T is realized by adding the speed vector C generated by an operation of the boom 8 to result from machine control to the speed vector B.

At S560, the target pilot pressure calculating section 43*h* calculates target pilot pressure for the flow control valve 15*a*, 15*b* or 15*c* of each hydraulic cylinder 5, 6, or 7 based on the target speed of each cylinder 5, 6, or 7 calculated at S550.

At S590, the target pilot pressure calculating section 43*h* outputs, to the solenoid proportional valve control section 44, the target pilot pressure for the flow control valve 15*a*, 15*b* or 15*c* of each hydraulic cylinder 5, 6, or 7. The solenoid proportional valve control section 44 controls the solenoid proportional valves 54, 55 or 56 such that the target pilot pressure acts on the flow control valve 15*a*, 15*b* or 15*c* of each hydraulic cylinder 5, 6, or 7, and thereby excavation by the work implement 1A is performed. For example, if an operator operates the operation device 45*b* to perform horizontal excavation by arm crowding operation, the solenoid proportional valve 55*c* is controlled such that the tip of the bucket 10 does not go beyond the target surface 60, and a raising operation of the boom 8 is automatically performed.

Note that although it is configured here such that the process proceeds to S530 if determination at S480 is YES in order to simplify explanation, the configuration may be changed such that the process proceeds to S500, instead of S530. With such a configuration, if arm crowding operation is performed further at the position where a posture of the arm 9 becomes substantially vertical, forcible boom lowering by machine control is activated, and excavation along the target surface 60 is performed; as a result, an excavation distance along the target surface 60 can be made longer. In addition, the flowchart illustrated in FIG. 14 is for explaining an example in which forcible boom raising is performed, control to decelerate a speed of the arm 9 may be added to the machine control as necessary, for improvement of excavation precision. In addition, control to keep an angle of the bucket 10 at a desired angle by controlling the solenoid proportional valves 56*c* and 56*d* may be added such that the angle B of the bucket 10 to the target surface 60 becomes a constant value in order to perform levelling work easily.

Even in case of an excavator controlled according to the flowchart illustrated in FIG. 14, by adjusting a level of machine control intervention utilizing the level-of-intervention input device 96 according to skills or preferences of an operator, effects of reducing man-hours and a mental burden can be attained.

<Modification of Relationship Among Level of Intervention, Limiting Value ay, and Distance D>

Figure 16:
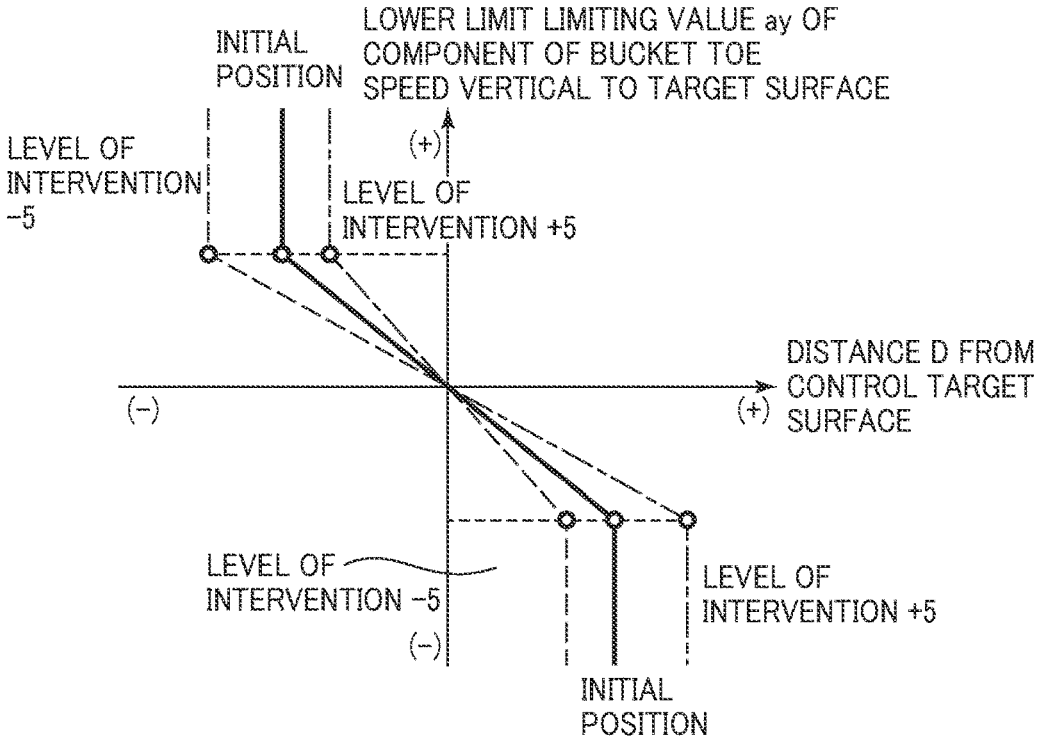
FIG. 16 is a figure illustrating a relationship among the limiting value ay, distance D and level of intervention.
Figure 17:
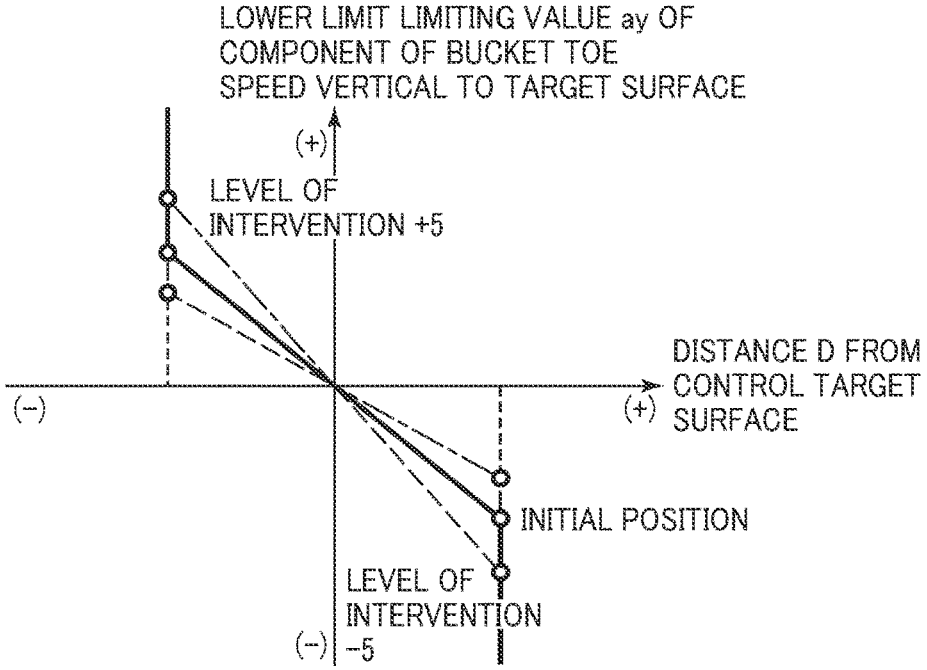
FIG. 17 is a figure illustrating a relationship among the limiting value ay, distance D and level of intervention.

The relationship among the level of intervention, limiting value ay, and distance D that can be utilized includes the one illustrated in FIG. 16 or FIG. 17, for example, other than the one illustrated in FIG. 10.

In the example illustrated in FIG. 16, a range has been determined for the distance D at which limitation is imposed on the component by vertical to the target surface 60 of the speed vector B, and the range is also set to change according to changes in the level of intervention. With such settings, the range in which the limitation is imposed on by can be changed directly. In addition, if the distance in which the limitation is imposed on by is displayed on the display section 375 of the display device 53, this is advantageous since an operator can intuitively realize the range in which the limitation is imposed on by.

In the example illustrated in FIG. 17, a range has been determined for the distance D at which limitation is imposed on the component by vertical to the target surface 60 of the speed vector B as in the example illustrated in FIG. 16, but the range is set not to change, and the limiting value is set to change according to changes in the level of intervention.

With such settings, the limiting value at which limitation starts to be imposed on by can be changed directly.

<Modification of Level-of-Intervention Input Device 96>

Figure 18A:
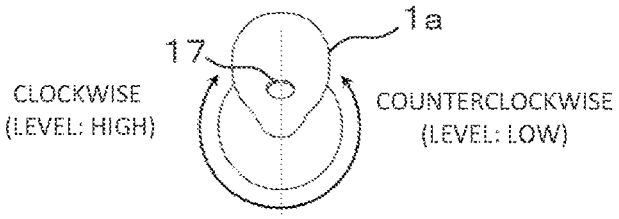
FIG. 18A is a top view of an operation lever provided with the level-of-intervention input device.
Figure 18B:
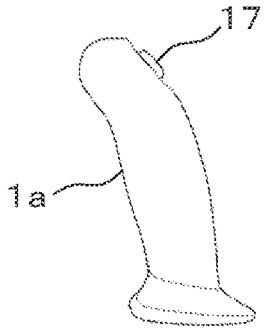
FIG. 18B is a side view of the operation lever provided with the level-of-intervention input device.
Figure 18C:
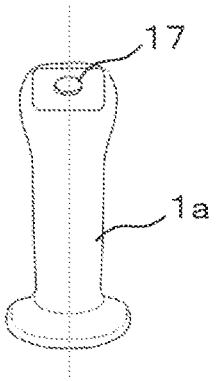
FIG. 18C is a front view of the operation lever provided with the level-of-intervention input device.

FIGS. 18A, B, and C are configuration diagrams of the operation lever 1*a* provided with the machine control ON/OFF switch 17, and function also as the level-of-intervention input device 96 (input device). FIG. 18A is a top view of the operation lever 1*a*, FIG. 18B is a side view of the operation lever 1*a*, and FIG. 18C is a front view of the operation lever 1*a*.

The operation lever 1*a* in FIG. 18 is configured to be able to rotate clockwise and counterclockwise about the lever axis as illustrated in FIG. 18A, and outputs a rotation direction and a rotation amount (an operation direction and an operation amount) to the controller 40 (machine control section 43) as a level of intervention. With such a configuration of the operation lever 1*a*, the level of intervention adjusted by an operator can be grasped not visually, but from the feeling of twisting of the operator's wrist to operate the operation lever 1*a*; as a result, it is easy to perform slope-tamping works while maintaining a desired pressing force. In addition, since the level of intervention can be adjusted without releasing the hand from the operation lever 1*a* during work, deterioration of work efficiency can be prevented.

Note that the input device 96 illustrated as an example in FIG. 8 and FIG. 18 can be constituted by a variable resistor to be operated along straight lines or the like. The variable resistor may be provided with detents or the like to make it possible to set a continuously free level of intervention, and to make it possible to set the level of intervention to a constant level easily.

<Effects>

Effects attained by the above-mentioned embodiment are summarized.

(1) In the above-mentioned embodiment, a hydraulic excavator 1 provided with: a work implement 1A driven by a plurality of hydraulic actuators 5, 6, and 7; operation devices 45*a*, 45*b*, and 46*c* that instruct the front work implement 1A on an operation according to operation by an operator; and a controller 40 having a machine control section 43 that executes machine control for moving the front work implement 1A following a predetermined condition at the time of operation of the operation devices 45*a*, 45*b*, and 46*c* includes: a level-of-intervention input device 96 that is operated by the operator, the controller 40 further has a correction amount calculating section 43*m* that calculates a correction amount of the level of intervention indicating a degree at which the machine control intervenes in the operation of the front work implement 1A instructed through operation of the operation devices 45*a*, 45*b*, and 46*c* based on an operation amount of the level-of-intervention input device 96, and the machine control section 43 executes the machine control to intervene in the operation of the front work implement 1A instructed through the operation of the operation devices 45*a*, 45*b*, and 46*c* at a level of intervention corrected based on the correction amount calculated at the correction amount calculating section 43*m*.

If a level of machine control intervention (limiting value for the speed vector B of the tip of the work implement 1A) in operator operation is configured to be changeable in this manner, a boom lowering speed at the time of collision with the target surface 60 can be adjusted by adjusting, by utilizing the level-of-intervention input device 96, the level of intervention within a range smaller than a value at the initial position, and thereby a pressing force at the time of slope-tamping can be adjusted. In addition, since the level of intervention which is adjusted by an operator can be grasped not visually, but by bodily sensing the extent of extending fingers when operating the level-of-intervention input device 96, slope-tamping works can be easily performed while maintaining a desired pressing force.

In addition, since an operation of a work implement beyond a target surface is suppressed in works using an excavator with a conventional machine control function (area limiting control function), it is not possible to press the bucket 10 against a target surface while the machine control is being executed. Because of this, in a situation where a series of four types of operation consisting of: (A) a semi-finishing excavating operation with one certain stroke; (B) a compacting operation by slope-tamping; (C) a finishing excavating operation by one next stroke; and (D) movement of an excavator parallel to a design and construction surface is repeated using machine control, the machine control needs to be turned off every time the slope-tamping at (B) is to be performed. Furthermore, since the finishing work at (C) under the machine control is performed thereafter, the machine control function that is once turned off before the slope-tamping works should be turned on, and this series of switching operation places a burden on an operator.

However, if the level-of-intervention input device 96 is provided to the operation lever 1*a* as in the present embodiment, the machine control function can be substantially turned off by lowering the level of intervention with the level-of-intervention input device 96, without releasing a hand from the operation levers 1*a* and 1*b*. Thereby, it becomes easy to temporarily turn off the machine control before slope-tamping or the like during a series of operations like the one mentioned above, and the burden on the operator can be reduced, and work efficiency can be improved.

In addition, although it is hard to always move the toe of the bucket 10 onto the target surface 60 by operator operation accurately, there are actually highly skilled operators who can move the toe of the bucket 10 to a position close to the target surface 60 faster than an operation regulated by machine control. If the machine control intervenes in works by this type of operators with settings similar to those for other operators, work speeds might lower to increase man-hours for the works. Then, the operators are mentally irritated if the operators' intended operation is unnecessarily intervened, and this may cause inconvenience in some cases such as increases in fatigue at the time of works. However, if the level-of-intervention input device 96 is provided as in the present embodiment, the level of intervention can be adjusted according to skills or preferences of the operators; therefore, works can be performed continuously without increasing man-hours or generating a mental burden.

(2) In particular, in the above-mentioned embodiment, the level-of-intervention input device 96 can be operated in the forward direction (one direction) and the backward direction (the other direction) relative to an initial position as a reference point. If the input device 96 is operated in the forward direction, the limiting value ay changes to make a degree of machine control intervention greater than the level of intervention at a state where the input device 96 is at the initial position, and if the input device 96 is operated in the backward direction, the limiting value ay changes to make the degree of machine control intervention lower than the level of intervention at the state where the input device 96 is at the initial position. Thereby, the range of adjustment of the level of intervention becomes broader, and it is further possible to adjust the level of intervention according to skills and preferences of operators.

(3) In addition, in the above-mentioned embodiment, the level-of-intervention input device 96 is provided to the operation lever 1*a* or 1*b* on which a hand of an operator is placed during work. Thereby, since the operator can adjust the level of intervention without releasing the hand from the operation lever 1*a* and 1*b* during work, deterioration of work efficiency can be prevented.

(4) In addition, in the above-mentioned embodiment, a degree of change of the limiting value ay (degree of the level of intervention) made through the level-of-intervention input device 96 is displayed on the display section 395 of the display device 53. Thereby, by looking at the display screen of the display device 53, an operator can easily grasp the current level of intervention.

<Additional Notes>

Although in the above-mentioned explanation, it is configured such that, as a predetermined condition to be followed by machine control, the limiting value ay of a magnitude of a component vertical to the target surface 60 of a speed vector of the tip of the work implement 1A is set for the speed vector B of the tip of the work implement 1A generated by operator operation (a first control signal), and the limiting value can be changed by operation of the level-of-intervention input device 96, it may be configured such that a limiting value (condition) other than this is provided for the magnitude and direction of the speed vector B, and this limiting value can be similarly changed by operation of the level-of-intervention input device 96. In this case, if the speed vector B of the tip of the work implement 1A generated by operator operation exceeds the limiting value, a second control signal to generate a speed vector of the tip of the work implement 1A that does not exceed the limiting value is calculated for at least one of the flow control valves 15*a*, 15*b*, and 15*c*.

Although the limiting value ay is decided in the above-mentioned explanation, it may be configured such that a value is calculated by multiplying a value equal to or smaller than 1 that becomes smaller as the distance D approaches zero with a vertical component of a bucket toe speed vector, and the hydraulic actuators 5, 6, and 7 (flow control valves 15*a*, 15*b*, and 15*c*) are controlled based on the calculated value.

Although in the flowchart illustrated in FIG. 12, control is performed using the bucket toe speed vector B as a reference vector, the control may be performed using a speed vector of the tip of the arm 9 as a reference vector in order to exclude the speed of the bucket 10 from consideration.

In addition, although the controller 40 is configured to be able to execute two modes which are the boom lowering deceleration mode illustrated in FIG. 12 and the boom raising/lowering mode illustrated in FIG. 14, the controller 40 may be configured to be able to execute either one mode. In this case, the mode determining section 43*n*, and accordingly a series of processes illustrated in FIG. 11 may become unnecessary.

Although in the above-mentioned explanation, it is configured such that the level of intervention can be changed by changing the limiting value ay with the level-of-intervention input device 96, the limiting value ay may be kept as in FIG. 9, and it may be configured such that the level of intervention can be changed by correcting a second control signal output from the target pilot pressure calculating section 43*h*.

The above-mentioned respective configurations related to the controller 40, functions and executed processes of the respective configurations, and the like may be partially or entirely realized by hardware (for example, by designing logics to execute the respective functions in an integrated circuit, and so on). In addition, the above-mentioned configurations related to the controller 40 may be embodied in a program (software) that realizes the respective functions related to the configurations of the controller 40 by being read out and executed by an arithmetic processing apparatus (for example, a CPU). Information related to the program can be stored, for example, in a semiconductor memory (a flash memory, an SSD, etc.), a magnetic storage device (a hard disk drive, etc.), and a recoding medium (a magnetic disk, an optical disk, etc.), or the like.

DESCRIPTION OF REFERENCE CHARACTERS

1A: Front work implement
8: Boom
9: Arm
10: Bucket
17: Machine control ON/OFF switch
30: Boom angle sensor
31: Arm angle sensor
32: Bucket angle sensor
40: Controller (control device)
43: Machine control section
43*a*: Operation amount calculating section
43*b*: Posture calculating section
43*c*: Target surface calculating section
43*d*: Cylinder speed calculating section
43*e*: Bucket toe speed calculating section
43*f*: Target bucket toe speed calculating section
43*g*: Target cylinder speed calculating section
43*h*: Target pilot pressure calculating section
43*n*: Mode determining section
43*m*: Correction amount calculating section
44: Solenoid proportional valve control section
45: Operation device (boom, arm)
46: Operation device (bucket, swing)
47: Operation device (travel)
50: Work implement posture sensor
51: Target surface setting device
52*a*, 52*b*: Operator operation sensor
53: Display device
54, 55, 56: Solenoid proportional valve
96: Level-of-intervention input device (input device)
374: Display control section
395: Level of intervention display section

The invention claimed is:

1. A work machine comprising:

a work implement driven by a plurality of hydraulic actuators;

an operation device that instructs the work implement according to an operation by an operator; and a controller configured to execute machine control for moving the work implement following a predetermined condition at time of operation of the operation device, and configured to store a limiting value for a magnitude of a vertical component, to a given target surface, of a speed vector of the tip of the work implement with respect to the target surface, the limiting value is set for each of target surface distances that are distances from the tip of the work implement to the target surface, the work machine including:

a level-of-intervention input device that is operated by the operator and that adjusts a degree of changing the magnitude of the limiting value for each target surface distance, wherein the controller is further configured to change the magnitude of the limiting value for each target distance according to an operation amount of the level-of-intervention input device, and control a speed of the tip of the work implement during execution of the machine control based on the changed magnitude of the limiting value for each target distance.

2. The work machine according to claim 1, wherein the predetermined condition is defined such that the machine control is executed if the target surface distance is equal to or shorter than a predetermined value, and wherein the predetermined value changes according to the operation amount of the level-of-intervention input device.

3. The work machine according to claim 1, wherein the controller is configured to execute the machine control such that if the magnitude of the vertical component of the speed vector generated by the operation of the operation device exceeds the limiting value, the magnitude of the vertical component of the speed vector is kept at the limiting value.

4. The work machine according to claim 1, wherein the level-of-intervention input device can be operated in at least one of one direction and an other direction relative to an initial position as a reference point, wherein if the level-of-intervention input device is operated in the one direction, the magnitude of the limiting value for each target surface distance changes to be greater than a magnitude of the limiting value for each target surface distance at a state where the level-of-intervention input device is at the initial position, and wherein if the level-of-intervention input device is operated in the other direction, the magnitude of the limiting value for each target surface distance changes to be lower than the magnitude of the limiting value for each target surface distance at the state where the level-of-intervention input device is at the initial position.

5. The work machine according to claim 1, wherein the operation device has a gripping section on which a hand of an operator is placed, and wherein the level-of-intervention input device is provided to the gripping section.

6. The work machine according to claim 1, further comprising a display device that displays the degree of changing of the magnitude of the limiting value for each target surface distance by an operation of the level-of-intervention input device.

* * * * *